US009888309B2

(12) United States Patent
Prelogar et al.

(10) Patent No.: US 9,888,309 B2
(45) Date of Patent: Feb. 6, 2018

(54) EAR JEWELRY WITH WIRELESS AUDIO DEVICE

(71) Applicants: Barrett Prelogar, Lake Ozark, MO (US); Patsy Prelogar, Lake Ozark, MO (US)

(72) Inventors: Barrett Prelogar, Lake Ozark, MO (US); Patsy Prelogar, Lake Ozark, MO (US)

( * ) Notice: Subject to any disclaimer, the term of this patent is extended or adjusted under 35 U.S.C. 154(b) by 0 days.

(21) Appl. No.: 15/189,251

(22) Filed: Jun. 22, 2016

(65) Prior Publication Data

US 2016/0373851 A1 Dec. 22, 2016

Related U.S. Application Data

(63) Continuation-in-part of application No. 14/798,073, filed on Jul. 13, 2015, which is a continuation of (Continued)

(51) Int. Cl.

| | |
|---|---|
| ***H04R 1/10*** | (2006.01) |
| ***A44C 7/00*** | (2006.01) |
| ***H04R 1/02*** | (2006.01) |

(52) U.S. Cl.

CPC ..... *H04R 1/1016* (2013.01); *A44C 7/00* (2013.01); *H04R 1/028* (2013.01); *H04R 1/1033* (2013.01);

(Continued)

(58) Field of Classification Search

CPC .... H04R 1/028; H04R 1/1033; H04R 1/1041; H04R 1/105; H04R 1/1066; H04R 1/1075;

(Continued)

(56) References Cited

U.S. PATENT DOCUMENTS 5,828,757 A 10/1998 Michalsen et al.
8,774,446 B2 7/2014 Merenda (Continued)

FOREIGN PATENT DOCUMENTS

WO 2007005221 A1 1/2007

OTHER PUBLICATIONS

Article dated Jan. 12, 2016 entitled Beats AirPods vs. top wireless earbuds debuted at CES 2016 by Mellisa Tolentino, posted by SiliconANGLE at http://siliconangle.com.

*Primary Examiner* — Mark Fischer
(74) *Attorney, Agent, or Firm* — Erickson Kernell IP, LLC

(57) ABSTRACT

An audio device worn in a piercing in an ear of a user. The audio device extends through the piercing and includes a wireless communications unit disposed at a first end and a sound-production unit coupled to an opposite second end thereof. The signal path from a master device to the sound-production unit for producing audio outputs thus passes through the pinna of the ear. The sound-production unit may include an ornamental cover such that the device can be worn as jewelry. The speaker and the wireless communications unit may be removable from a body of the device to enable the body to be worn alone as jewelry and to allow replacement of the wireless communications unit with a wired connection. The device may include a control surface useable to provide inputs to the master device coupled to the device.

19 Claims, 35 Drawing Sheets

Related U.S. Application Data application No. 13/835,975, filed on Mar. 15, 2013, now Pat. No. 9,084,054.

(60) Provisional application No. 61/640,303, filed on Apr. 30, 2012.

(52) U.S. Cl.
CPC ..... *H04R 1/1041* (2013.01); *H04R 1/1066* (2013.01); *H04R 2201/023* (2013.01); *H04R 2420/07* (2013.01)

(58) Field of Classification Search
CPC ..... H04R 1/1091; H04R 2201/023; H04R 2201/10; H04R 2420/07; A44C 7/00
See application file for complete search history.

(56) References Cited

U.S. PATENT DOCUMENTS

| | | | | |
|---|---|---|---|---|
| 2008/0311966 | A1* | 12/2008 | Klein | H04M 1/05 455/575.2 |
| 2010/0041447 | A1* | 2/2010 | Graylin | H04M 1/05 455/575.2 |
| 2011/0164776 | A1* | 7/2011 | Kelly | H04R 1/1016 381/379 |
| 2014/0098983 | A1* | 4/2014 | Clow | H04R 1/1091 381/375 |

* cited by examiner

EAR JEWELRY WITH WIRELESS AUDIO DEVICE

CROSS-REFERENCE TO RELATED APPLICATIONS

This application is a continuation-in-part of U.S. patent application Ser. No. 14/798,073, filed Jul. 13, 2015 titled "Ear Jewelry With Wireless Audio Device" which is a continuation of U.S. patent application Ser. No. 13/835,975 filed Mar. 15, 2013 and issued on Jul. 14, 2015 as U.S. Pat. No. 9,084,054, also titled "Ear Jewelry with Wireless Audio Device" and to U.S. Provisional Patent Application No. 61/640,303, filed Apr. 30, 2012 and titled "Headphone Apparatus", the disclosures of each of which are hereby incorporated herein in their entirety by reference.

BACKGROUND

Piercing of various parts of the body for insertion of jewelry has been conducted by humans for thousands of years for a variety of reasons. Some piercings are completed for religious or spiritual beliefs and ceremonies while others are for ornamental purposes. The most common piercings are those in lobes of the ears, but a variety of other locations both in different parts of the ear as well as other parts of the body are not uncommon. For example, ear piercings are commonly formed in cartilaginous parts of the ear like the helix, concha, or tragus, among others.

Common earrings include a thin stud that is inserted through the lobe of the ear and retained in place by a clutch installed thereon. However, some subcultures or piercing "purists" employ larger body jewelry that requires or forms much larger piercings in the lobe or other portions of the ear. The body jewelry worn in these piercings is often held in place without the use of a clutch or other fastener and may require insertion into a piercing by stretching the piercing to allow passage of an enlarged end of the jewelry and then allowing the piercing to shrink or return to an original size to retain the jewelry therein in a frictional or obstructive engagement.

These body jewelry pieces are available in a variety of types. One type of body jewelry that is often used in cartilaginous parts of the ears is referred to as an industrial piercing. The industrial comprises an elongate rod with enlarged ends that is typically disposed to extend through a pair of piercings in the upper portion of the ear. Another form or variation of an industrial piercing is a spiral piercing which includes a spiral shaped body that is disposed in two or more piercings in the ear and may spiral or wrap around an edge or the scapha of the ear.

Gauge-style earrings comprise piercings in which a small initial piercing is created through, for example, the lobe of the ear. The piercing is then expanded or stretched over time by placing incrementally larger earrings therein. These earrings are referred to by their diametrical size measured using the American Wire Gauge (AWG) standard or in millimeters. Such earrings include those referred to as a taper and a gauge. A taper typically includes a generally conical body that is larger at one end than the other. An enlarged ball or similar feature may be disposed at the point thereof. The taper may be employed to slowly expand the piercing. The weight of the taper can apply a stretching force on the piercing as a result of the expanding shape of the taper as it is pulled through the piercing. Gauge-style earrings generally comprise a ring, also known as a tunnel, or a plug that is disposed within the piercing.

Piercings and/or clamps or wraps have also been employed to support audio devices, such as hearing aids and speakers, on the ear of a user. For example, U.S. Pat. No. 8,086,288 to Klein describes a wireless earring headset that is attached to the lobe of a user's ear via a stud extending through a small piercing in the user's ear and held in place by a clutch or clasp coupled to the stud. The headset includes a speaker that is directed toward the user's ear canal and a microphone disposed on a boom directed toward the user's mouth. This configuration with the large body and the microphone boom extending therefrom may be found by users to be bulky and unattractive for wearing in public or in a social setting.

U.S. Pat. No. 7,536,150 to Ryann describes a wireless earpiece assembly configured to give the appearance of an earring. The assembly is attached to the lobe of the user's ear via a stud or clasp which fully supports the assembly. Other contact with the ear is avoided to reduce discomfort caused by long-term use. The assembly includes a coupling mechanism or hoop on which a speaker and a casing are disposed. The speaker is positioned to direct sound toward the user's ear canal and the casing is suspended from the coupling mechanism and houses operational components of the assembly. Although, the configuration described by the '150 patent is ostensibly designed to resemble an earring, the speaker is fully visible and disposed adjacent the ear of the user during wearing of the assembly.

U.S. Patent Application Publication No. 2012/0308069 to Stott describes a gauge-style piercing with a speaker disposed therein. The speaker is directed outwardly and away from the user's ear to enable the user to hear audio outputs therefrom while also retaining the ability to hear sounds from their surroundings and environment. The '069 publication teaches that such a configuration is necessary to ensure the safety of the user and to avoid bulky or uncomfortable headphones that are placed in the user's ear canal and that block out environmental noises. However, such a configuration broadcasts the audio outputs to the user's surroundings, which may be unwanted by the user or by those nearby.

A need exists for body jewelry disposable in a piercing and with an integral audio device that can be disguised as ornamental jewelry when not used as an audio device. A need also exists for such a device that is configured for gauge and cartilaginous piercings.

SUMMARY

Embodiments of the invention are defined by the claims below, not this summary. A high-level overview of various aspects of the invention are provided here for that reason, to provide an overview of the disclosure, and to introduce a selection of concepts that are further described in the Detailed-Description section below. This summary is not intended to identify key features or essential features of the claimed subject matter, nor is it intended to be used as an aid in isolation to determine the scope of the claimed subject matter. In brief, this disclosure describes, among other things, a device that is wearable in an ear piercing as body jewelry and that includes an integral audio device.

The device includes a body with a wireless communications unit and a sound-production unit, such as a speaker or transducer coupled thereto. The wireless communications unit is connected to a first end of the body and transmits audio output signals through the body to the sound-production unit. The sound-production unit is coupled to the opposite second end of the body via a flexible conduit to allow the sound-production unit to be placed in proximity to or at least partially in the ear canal of the user when listening to audio output. When listening is not desired, the sound-production unit can be covered by an ornamental cover and suspended from the second end of the body or disposed within the body.

The wireless communications unit may be detachable from the body to enable a wired connection to be made to the body. The wireless communication unit, the body, and/or the sound-production unit might also include one or more input surfaces that can be manipulated by a user to control a master device that is coupled thereto.

DESCRIPTION OF THE DRAWINGS

Illustrative embodiments of the invention are described in detail below with reference to the attached drawing figures, and wherein.

Figure 31:
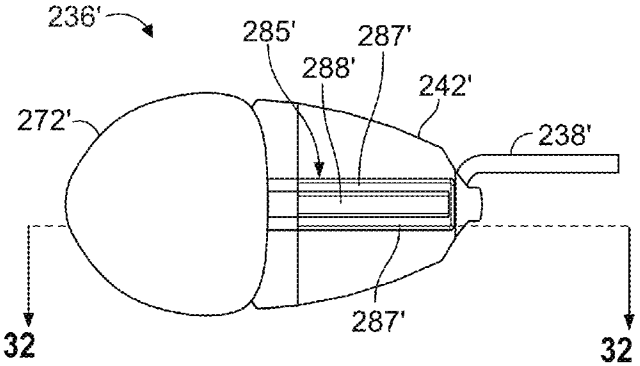
FIG. 31 is a second side elevational view of the sound-production unit of FIG. 27 shown with the leaves in a non-use orientation.
Figure 32:
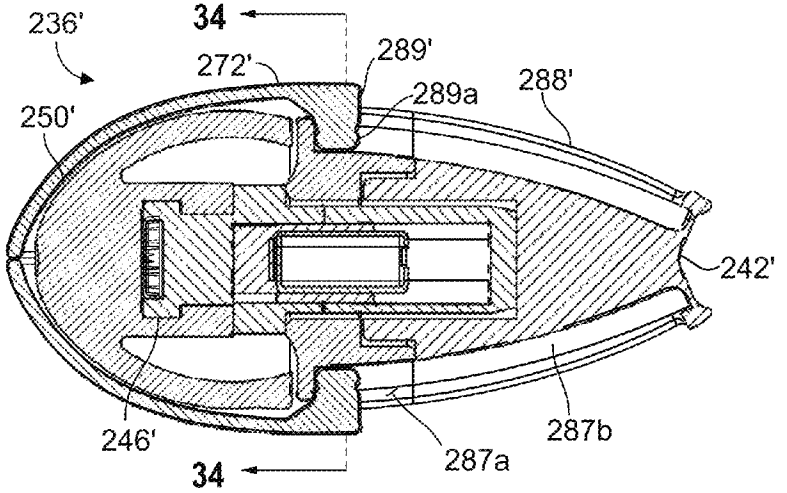
FIG. 32 is a cross-sectional view of the sound-production unit of FIG. 31 taken along the line 32-32 shown in FIG. 31 and depicted in accordance with an embodiment of the invention.
Figure 34:
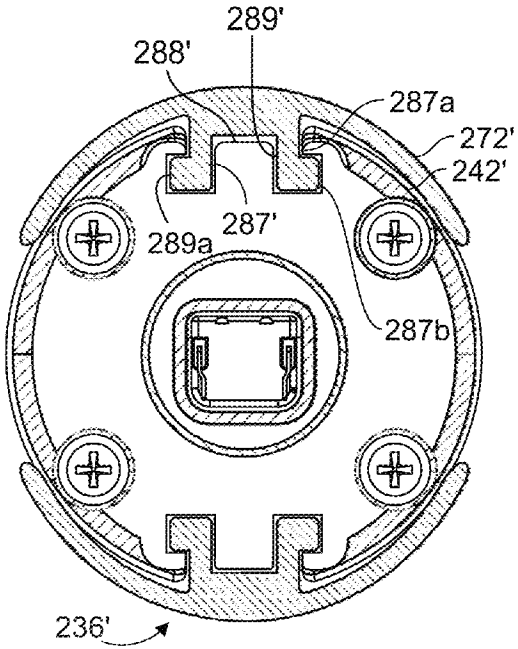
Figure 35:
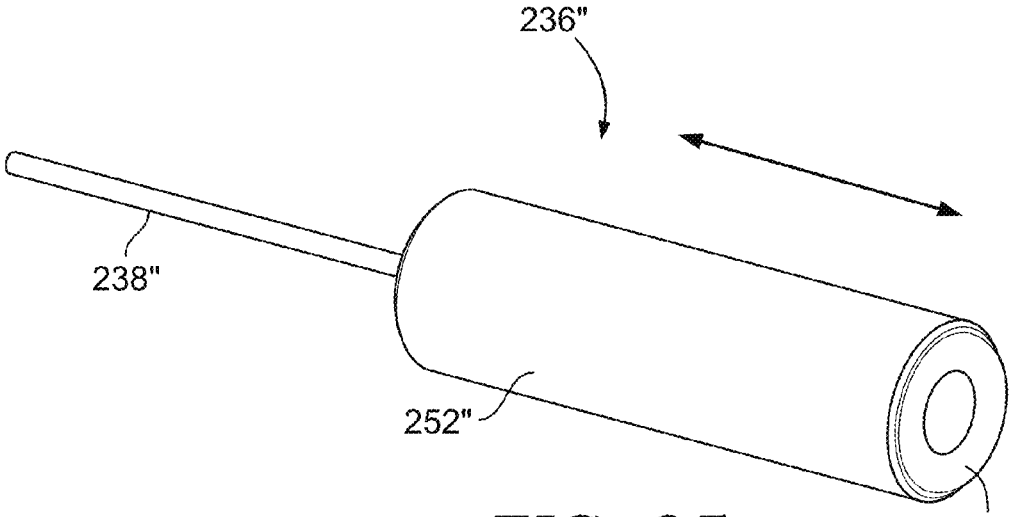
Figure 36:
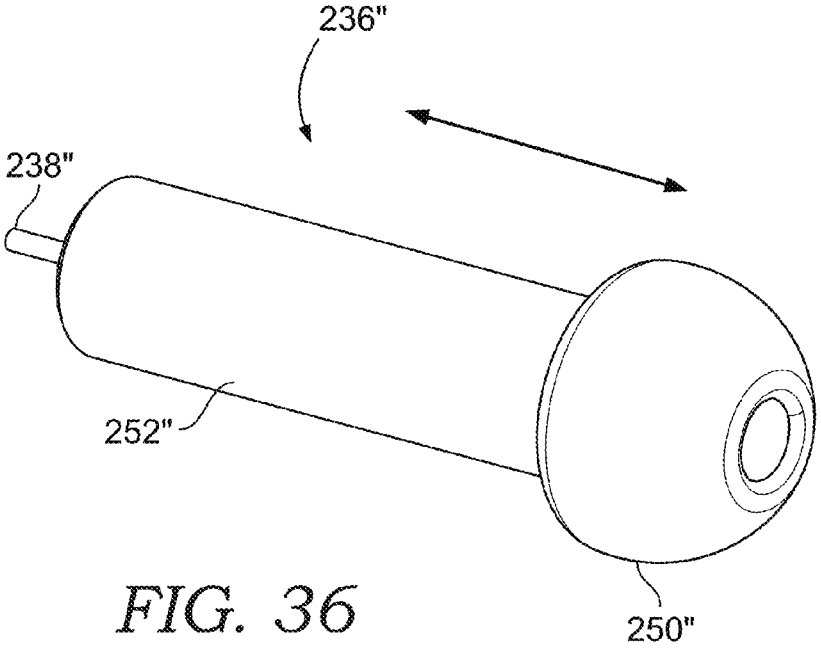
Figure 37:
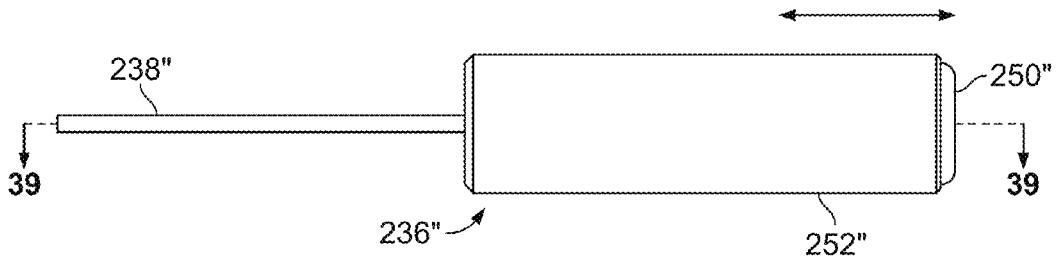
Figure 38:
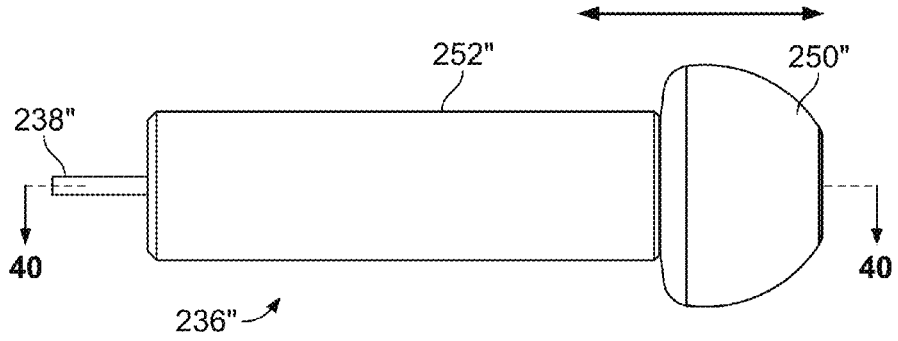
Figure 39:
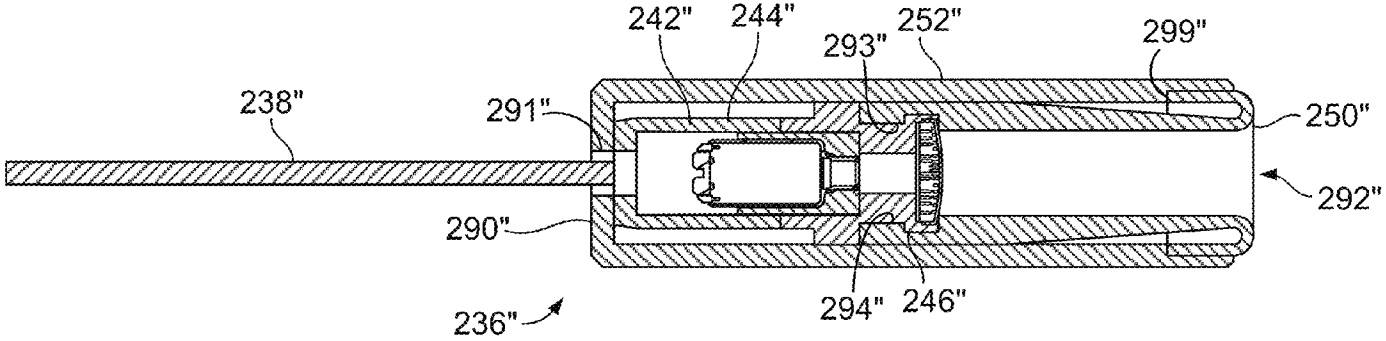
Figure 40:
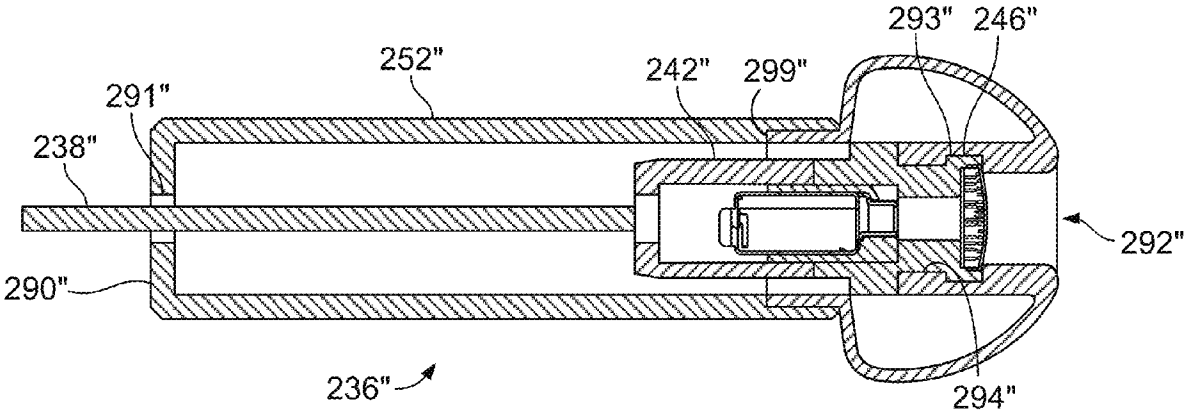
Figure 42:
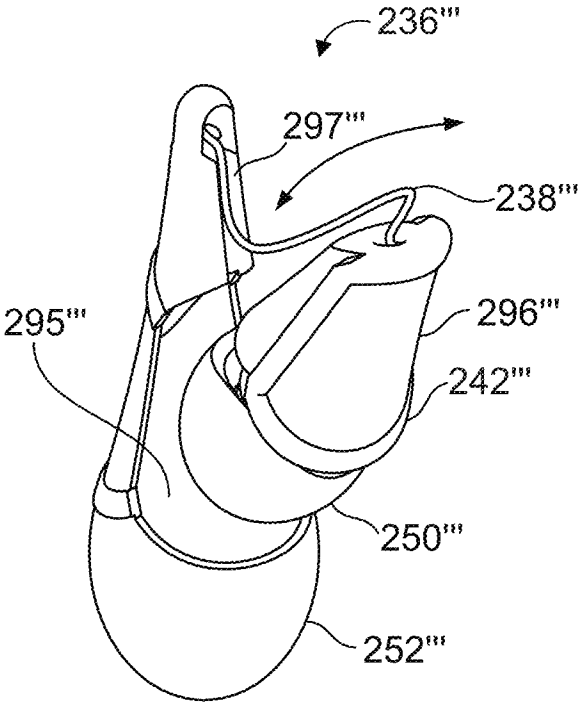
Figure 41:
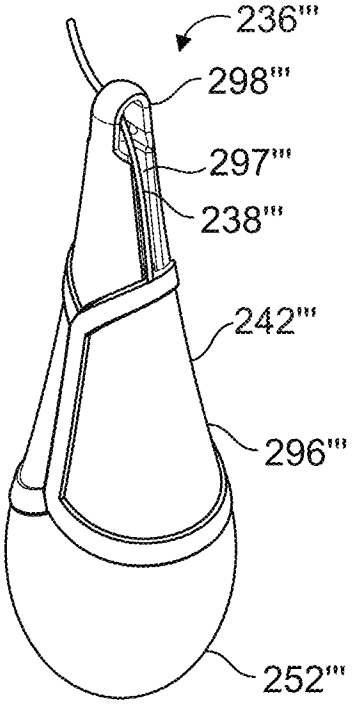
Figure 44:
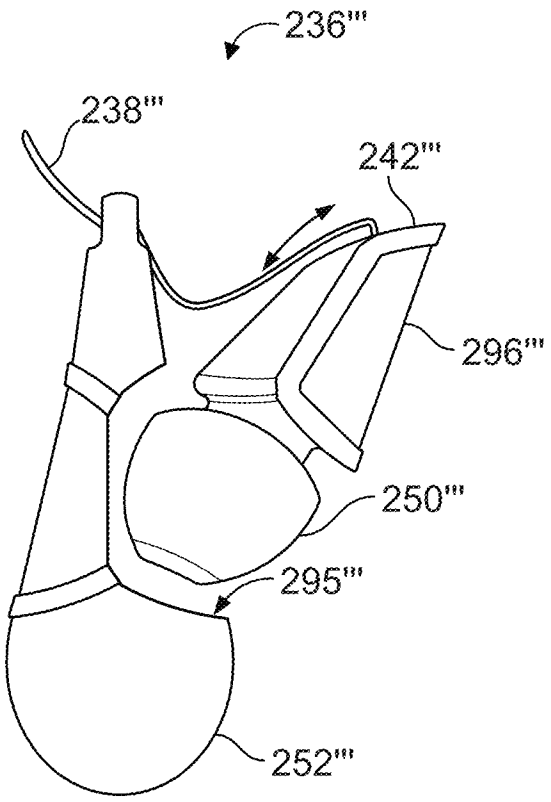
Figure 43:
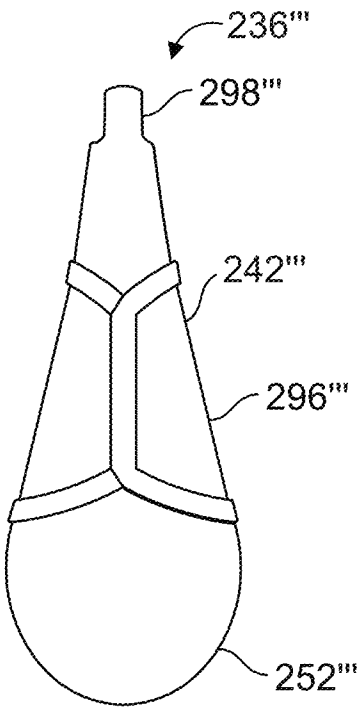
Figure 46:
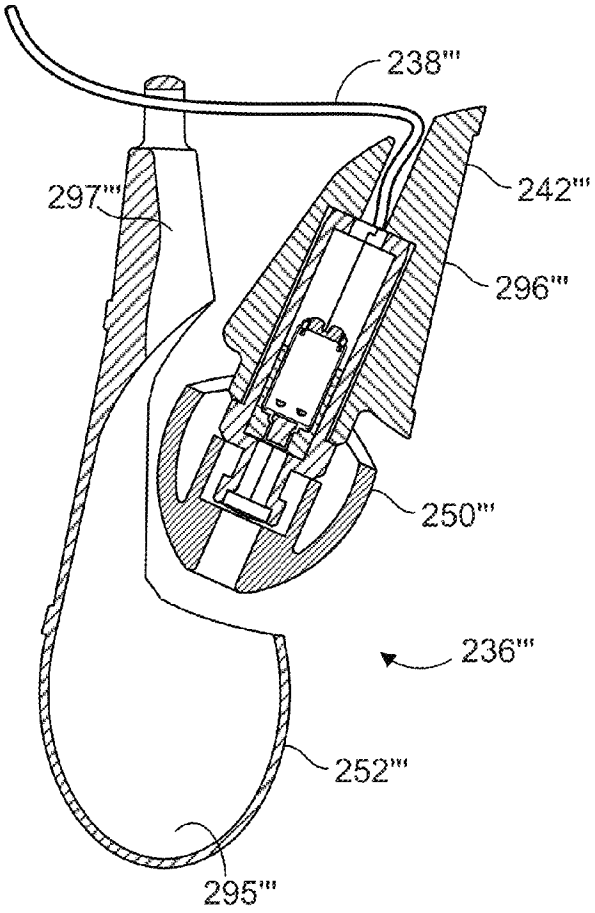
Figure 45:
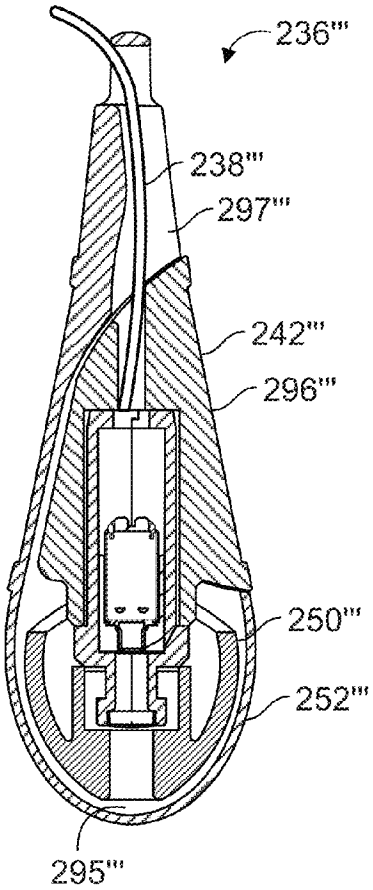
Figure 47:
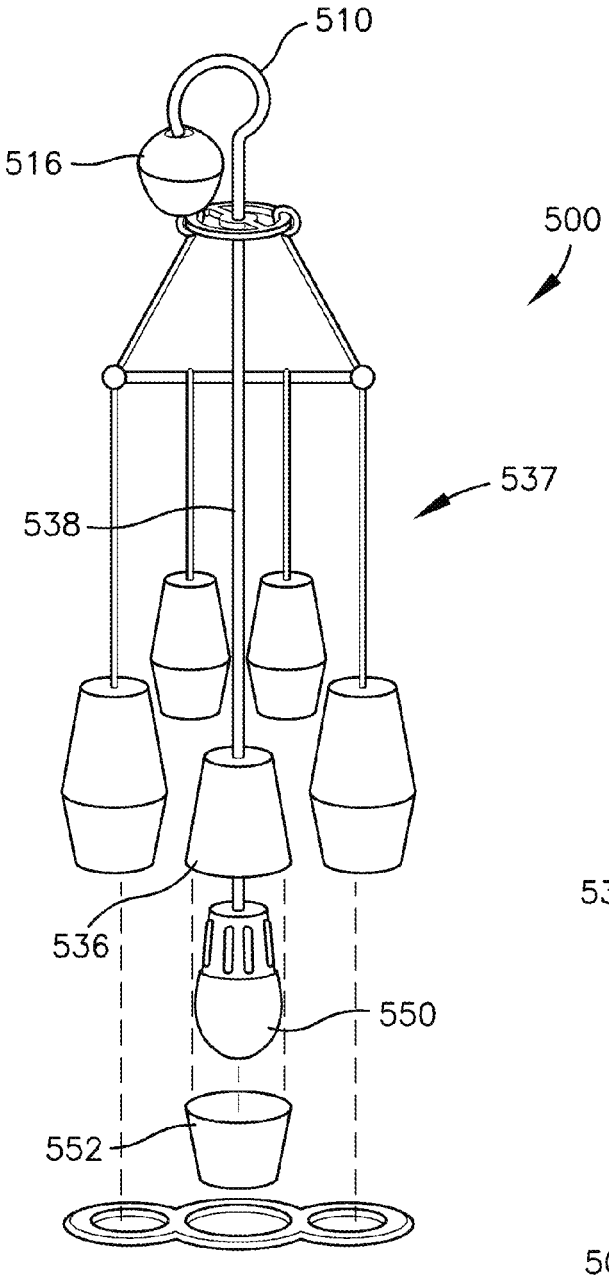
Figure 48:
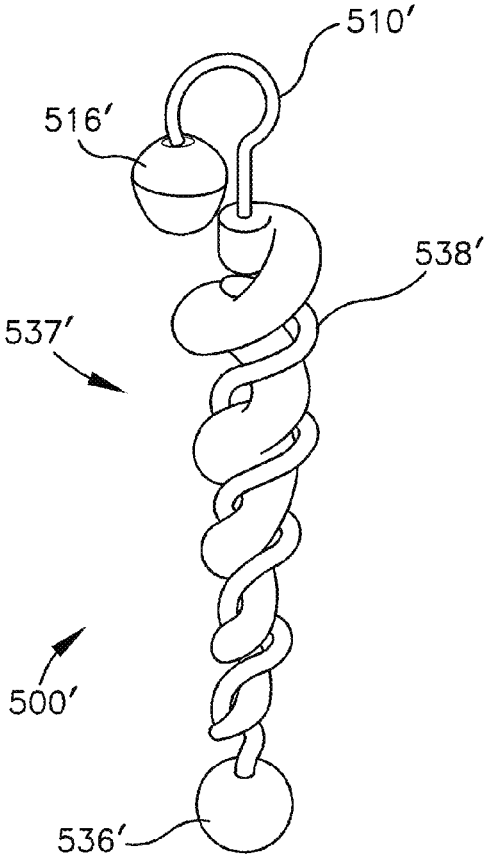
Figure 49:
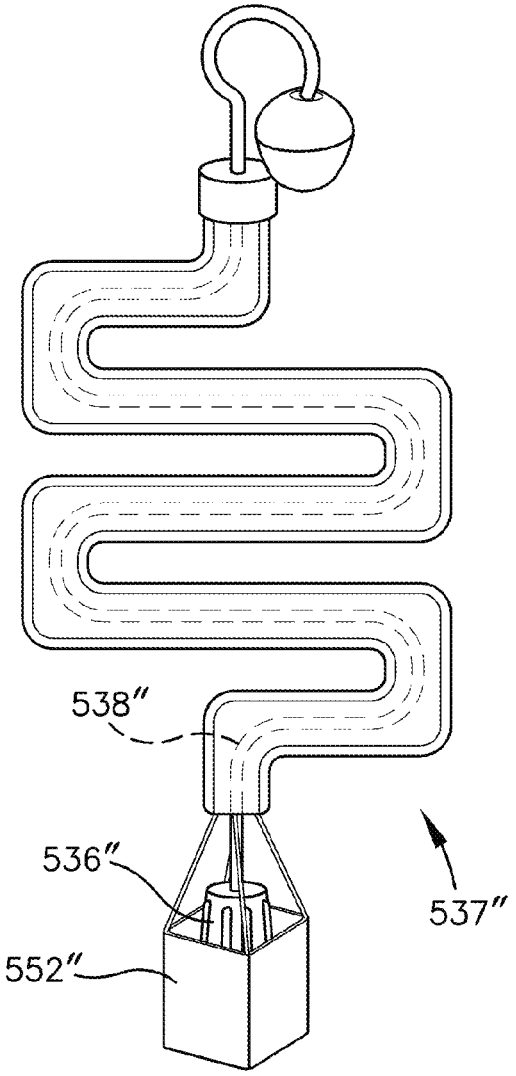
Figure 50:
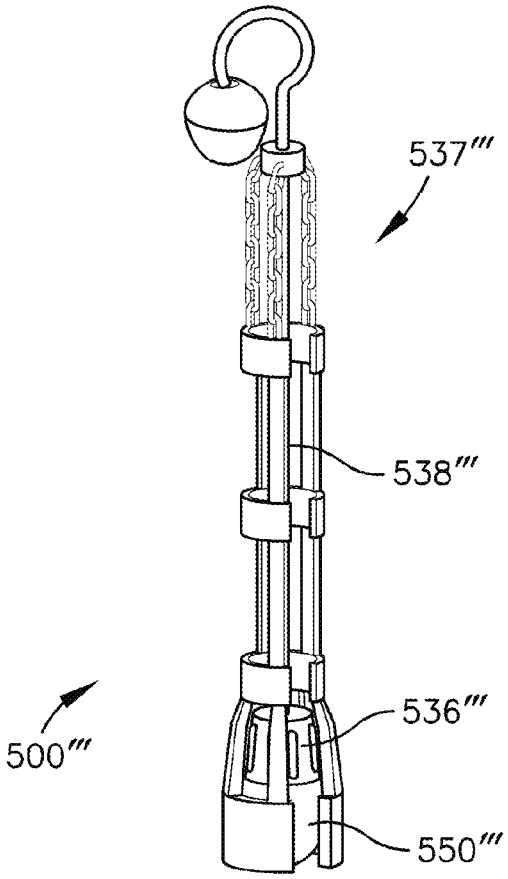
Figure 51B:
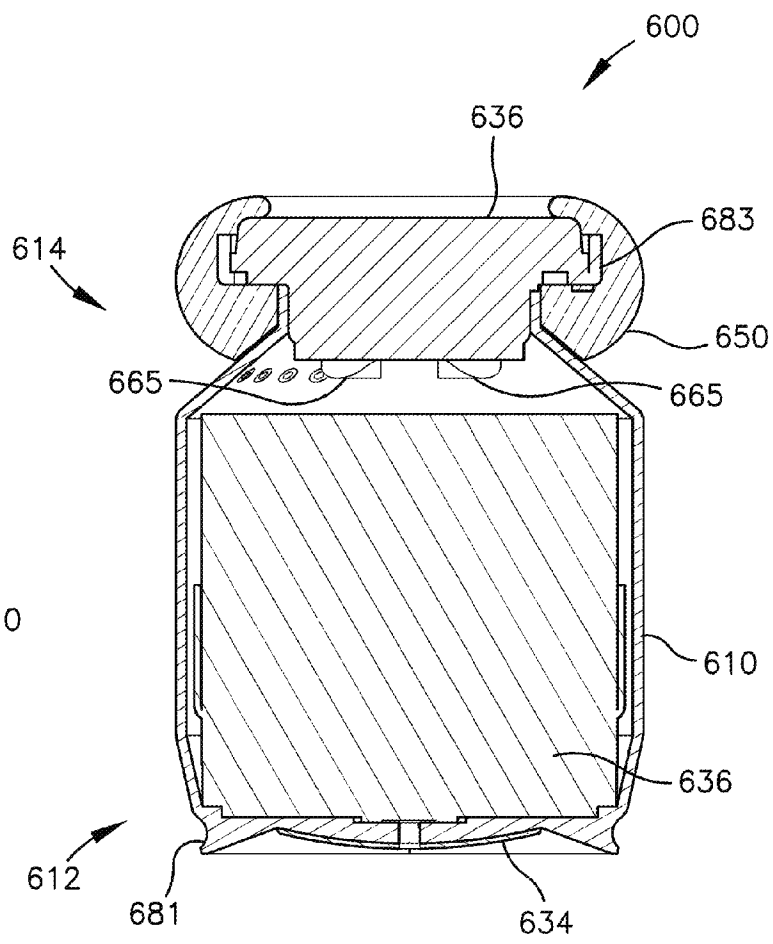
Figure 51A:
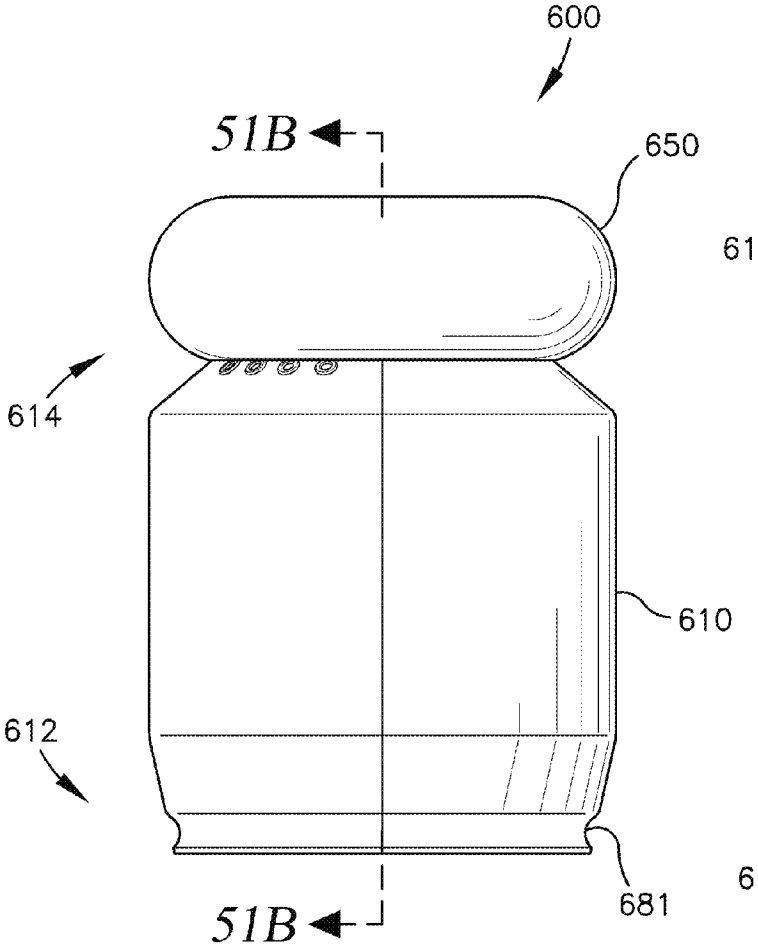
Figure 52B:
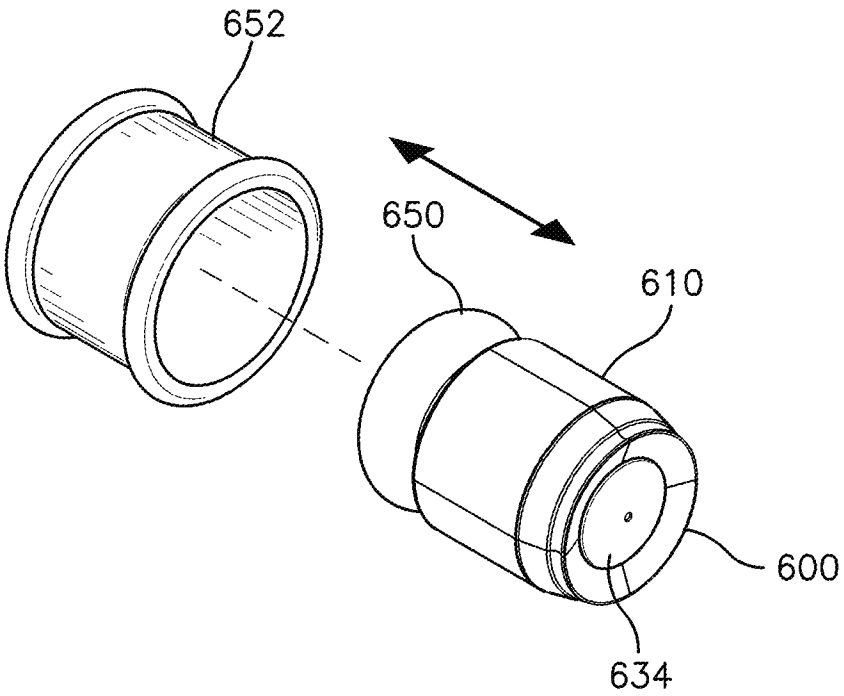
Figure 52A:
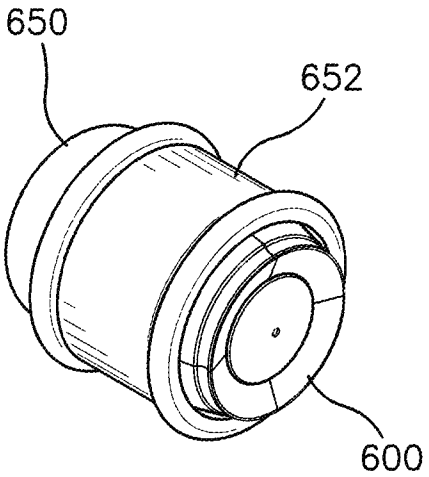
Figures 53A, 53B:
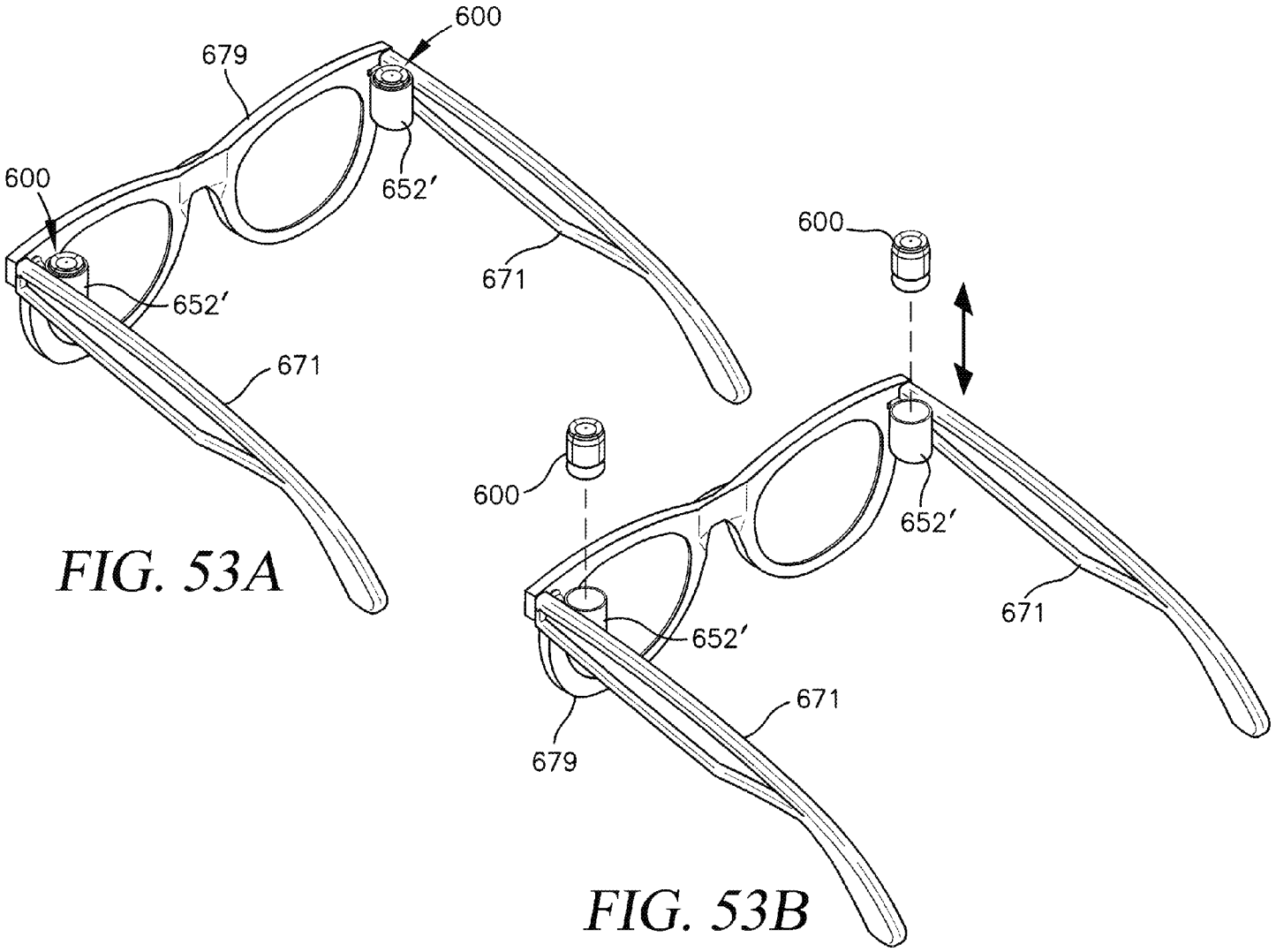
Figure 54B:
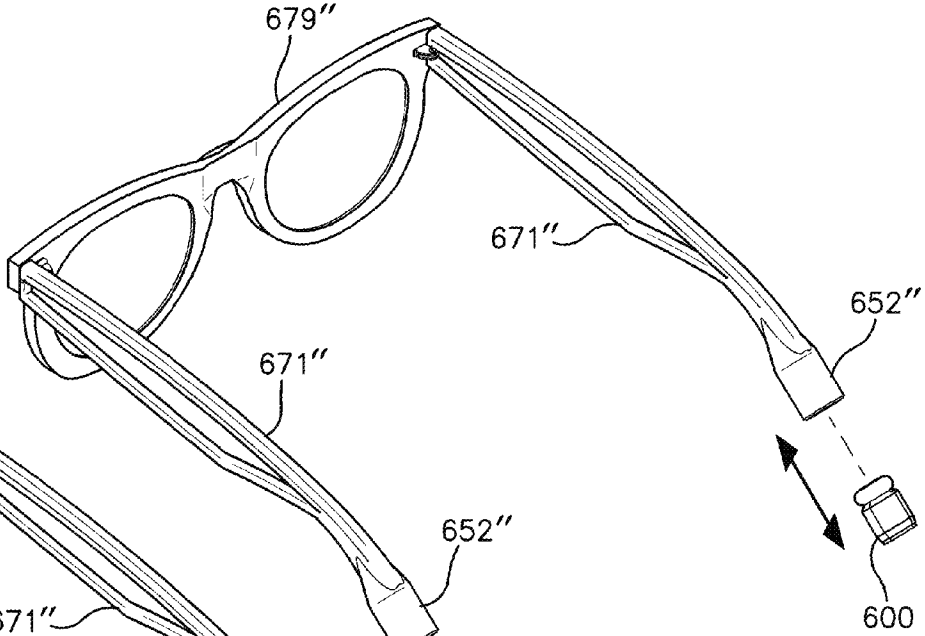
Figure 54A:
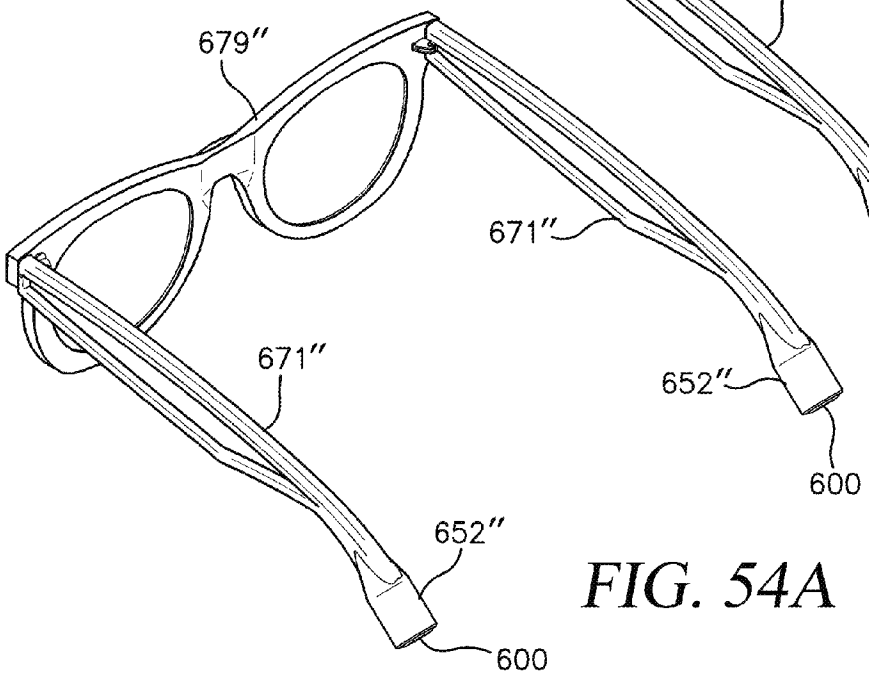
Figure 55B:
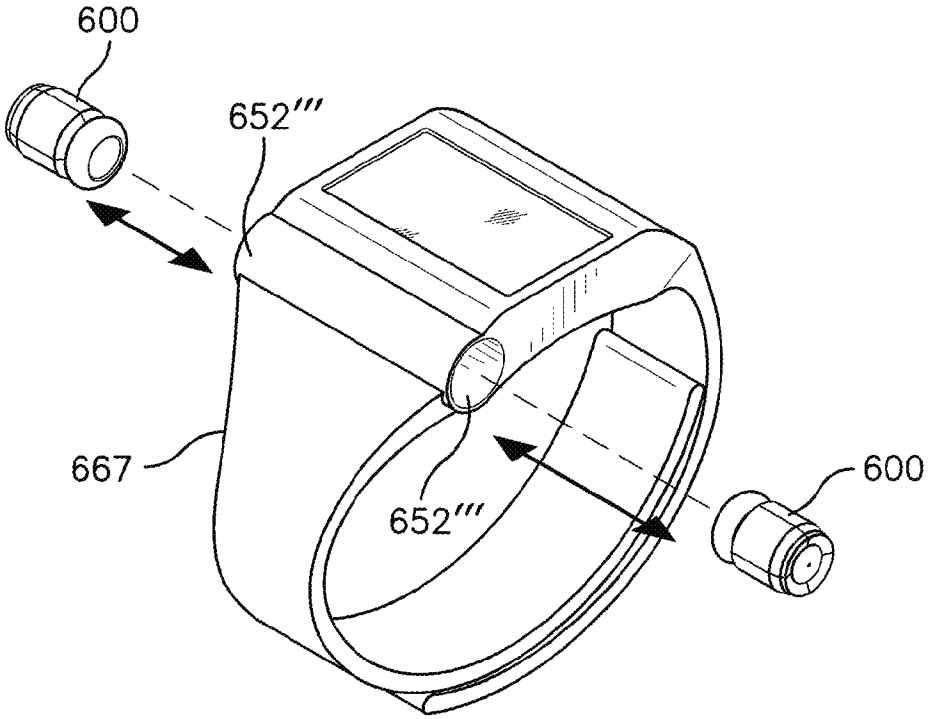
Figure 55A:
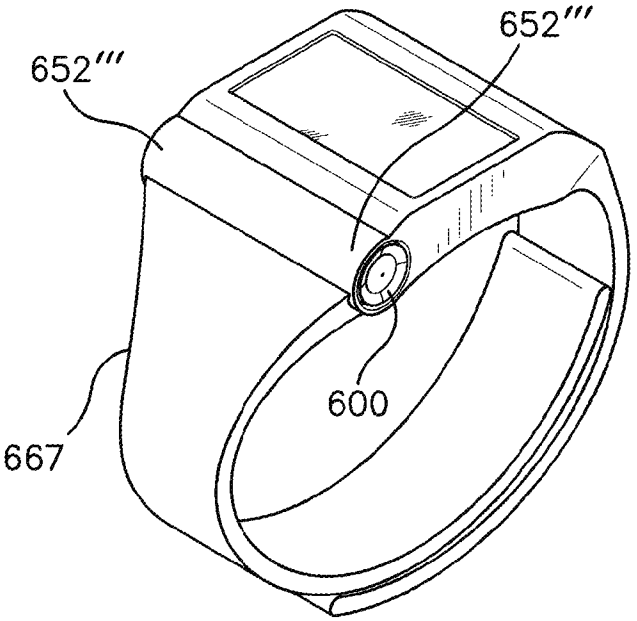

FIG. 34 is a cross-sectional view of the sound-production unit of FIG. 31 taken along the line 34-34 shown in FIG. 32 and depicted in accordance with an embodiment of the invention;

FIG. 35 is a perspective view of a sound-production unit with a telescoping cover in a non-use orientation depicted in accordance with an embodiment of the invention;

FIG. 36 is a perspective view of the sound-production unit of FIG. 35 depicted in a use orientation in accordance with an embodiment of the invention;

FIG. 37 is a side elevational view of the sound-production unit of FIG. 35;

FIG. 38 is a side elevational view of the sound-production unit of FIG. 36;

FIG. 39 is a cross-sectional view of the sound-production unit of FIG. 35 taken along the line 39-39 shown in FIG. 37 and depicted in accordance with an embodiment of the invention;

FIG. 40 is a cross-sectional view of the sound-production unit of FIG. 36 taken along the line 40-40 shown in FIG. 38 and depicted in accordance with an embodiment of the invention;

FIG. 41 is a perspective view of another sound-production unit in a non-use orientation and depicted in accordance with an embodiment of the invention;

FIG. 42 is a perspective view of the sound-production unit of FIG. 41 in a use orientation;

FIG. 43 is a side elevational view of the sound-production unit of FIG. 41;

FIG. 44 is a side elevational view of the sound-production unit of FIG. 42;

FIG. 45 is a cross-sectional view of the sound-production unit of FIG. 41 depicted in accordance with an embodiment of the invention;

FIG. 46 is a cross-sectional view of the sound-production unit of FIG. 42 depicted in accordance with an embodiment of the invention;

FIG. 47 is a perspective view of an audio device that includes an ornamental structure depicted in accordance with an embodiment of the invention;

FIG. 48 is a perspective view of an audio device that includes an ornamental structure with a spiraling body depicted in accordance with an embodiment of the invention;

FIG. 49 is a perspective view of an audio device that includes an ornamental structure with a snaking form depicted in accordance with an embodiment of the invention;

FIG. 50 is a perspective view of an audio device that includes an ornamental cage-like structure depicted in accordance with an embodiment of the invention:

FIG. 51A is a side perspective view of an audio device configured as an integrated unit depicted in accordance with an embodiment of the invention;

FIG. 51B is a cross-sectional diagram of the audio device of FIG. 51A taken along the line A-A depicted in accordance with an embodiment of the invention;

FIGS. 52A and 52B are perspective views of the audio device of FIG. 51A depicted within and removed from a cover that is configured as a gauge-style piercing in accordance with an embodiment of the invention;

FIGS. 53A and 53B are perspective views of the audio device of FIG. 51A depicted within and removed from a cover that is integrated into the temple pieces of a pair of glasses in accordance with an embodiment of the invention;

FIGS. 54A and 54B are perspective views of the audio device of FIG. 51A depicted within and removed from a cover that is integrated into distal ends of the temple pieces of a pair of eyeglasses in accordance with an embodiment of the invention; and FIGS. 55A and 55B are perspective views of the audio devices of FIG. 51A depicted within and removed from a cover that is integrated into a wristband in accordance with an embodiment of the invention.

DETAILED DESCRIPTION

The subject matter of select embodiments of the invention is described with specificity herein to meet statutory requirements. But the description itself is not intended to necessarily limit the scope of claims. Rather, the claimed subject matter might be embodied in other ways to include different components, steps, or combinations thereof similar to the ones described in this document, in conjunction with other present or future technologies. Terms should not be interpreted as implying any particular order among or between various steps herein disclosed unless and except when the order of individual steps is explicitly described.

Embodiments of the invention are described herein with respect to the drawings in which reference numerals are employed to identify particular components or features. Corresponding elements in the various embodiments depicted are provided with reference numerals having matching second and third digits but with differing first digits, e.g. element 10 corresponds to elements 110, 210, etc. Such is provided to avoid redundant description of corresponding features of the elements but is not intended to indicate the features or elements are necessarily the same.

Figure 1:
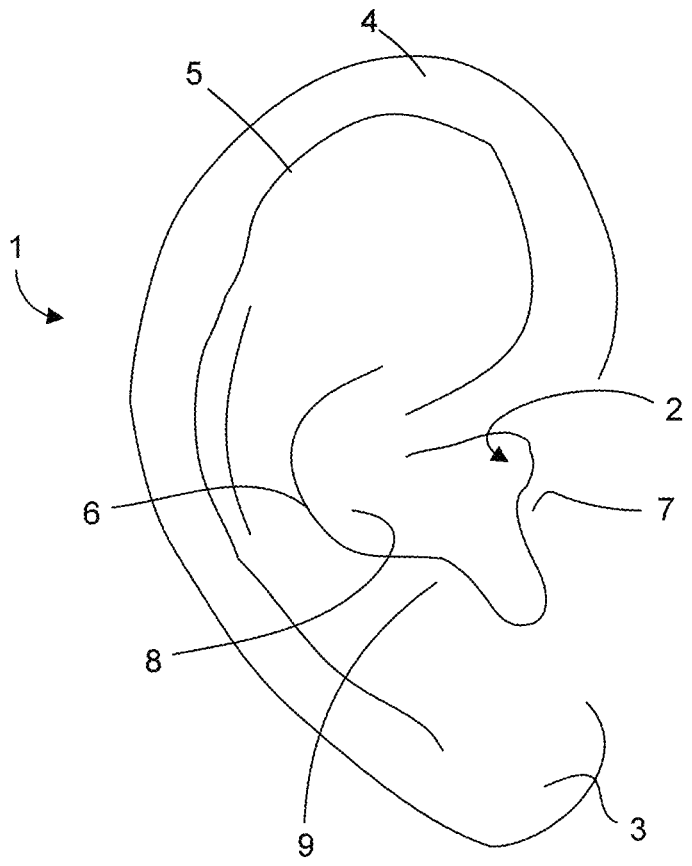
FIG. 1 is a diagram depicting the pinna or outer portion of a human ear and parts thereof.
Figure 2:
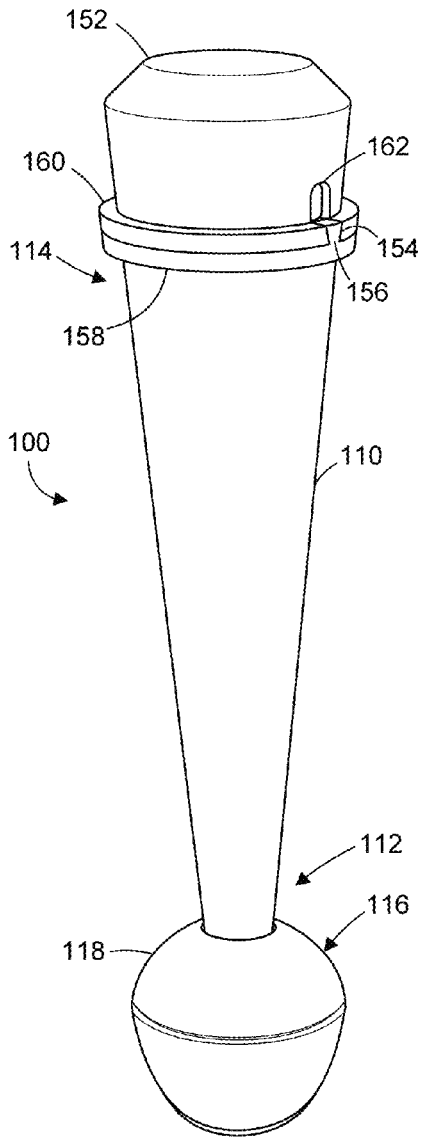
FIG. 2 is a perspective view of an audio device configured as a taper-style earring depicted in accordance with an embodiment of the invention.

With initial reference to FIG. 1, an external portion or pinna 1 of a human ear is depicted. The pinna 1 comprises a soft appendage generally comprised of cartilage and soft or fleshy tissues that collect and direct sound toward the ear canal 2 for receipt by the inner ear as known in the art. A variety of portions of the pinna 1 may be pierced for insertion of body jewelry. For example, the lobe 3 comprises fleshy tissues such as skin, and may be pierced for insertion of an earring or body jewelry such as a taper- or gauge-style earring. Hereinafter, earrings and body jewelry that are insertable in a piercing in the pinna 1 are collectively referred to as earrings. The helix 4, scapha 5, antihelix 6, tragus 7, concha 8, and antitragus 9 are cartilaginous portions of the pinna 1 that can be pierced for insertion of earrings known as an industrial, spiral, rook, tragus, and conch, among others.

With reference now to FIGS. 2-8, an audio device 100 that is wearable in a piercing in the pinna 1 of the ear is described in accordance with an embodiment of the invention. The audio device 100 is configured as a taper-style earring and includes a body 110 having a generally conical form. The conical form provides a first end 112 of the body 110 with dimensions that are smaller than those of an opposite second end 114. Although the body 110 is described herein as including a linear or straight conical taper-style form, it is to be understood that the body 110 can take a variety of different taper-style forms including for example, curved, spiral, claw, or horn shaped tapers among others. The body 110 includes a substantially hollow interior space and is removably coupled at the first end 112 to a control unit 116.

The control unit 116 includes a housing 118 having dimensions larger than the first end 112 of the body 110, e.g. the housing 118 has a diameter that is larger than the diameter of the first end 112 of the body 110, but the housing 118 can have any desired dimensions—larger or smaller than those of the body 110. The housing 118 is preferably configured in a spheroidal form but any desired form can be employed. The size and shape of the housing 118 may aid in avoiding inadvertent withdrawal of the audio device 100 from the piercing. Other components might also or alternatively be employed to avoid inadvertent withdrawal and/or to maintain positioning of the body 110 in the piercing, such as rubber O-rings.

Figure 5:
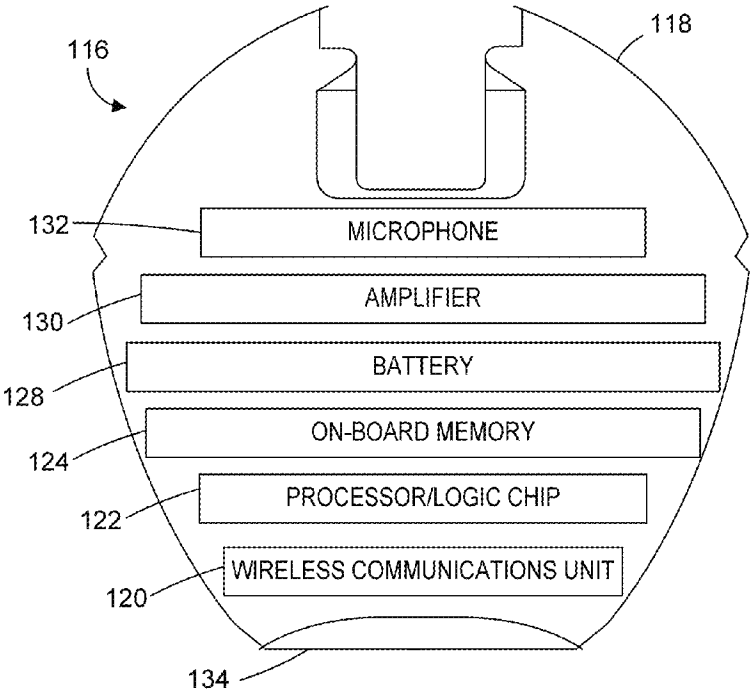
FIG. 5 is a block diagram depicting components of a control unit of an audio device depicted in accordance with an embodiment of the invention.

As depicted in FIG. 5, a variety of components are disposed in the housing 118 and configured for operation of the audio device 100 including a wireless communications unit 120, a processor or logic chip 122, an on-board memory 124, and a battery 128. An amplifier 130 and a microphone 132 might also be included, among a variety of other components. It is to be understood that one or more of these components can be combined or their functions performed by another component. For example, processors can include memory. Additionally, detail of the connections and communications between the components is not necessary for conveying an understanding of embodiments of the invention and is not described in detail herein.

Figure 7:
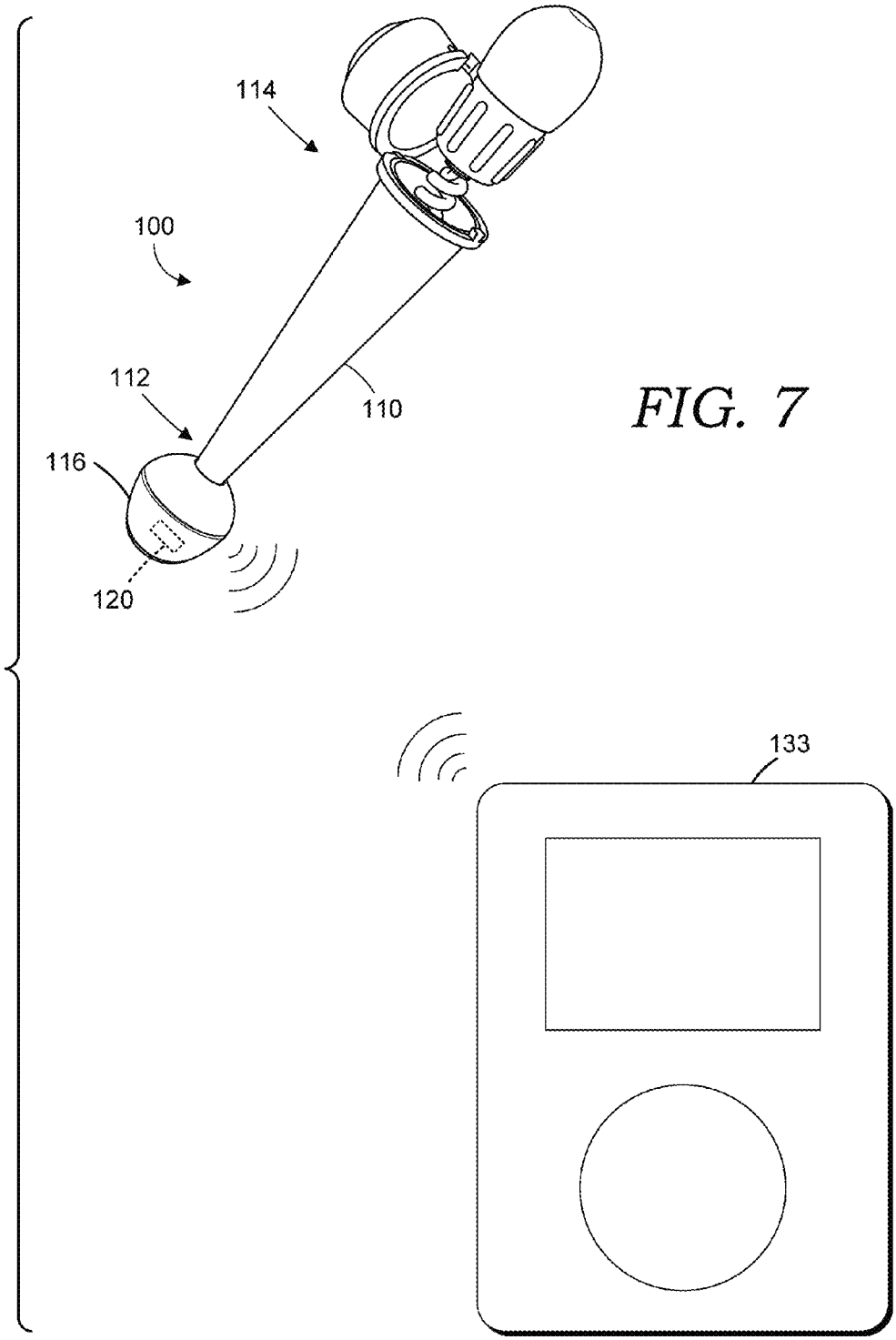
FIG. 7 is a diagrammatic view of wireless communications between a wireless communications unit disposed in a control unit of the audio device of FIG. 2 and a master device depicted in accordance with an embodiment of the invention.

The wireless communications unit 120 employs wireless communications protocols, standards, hardware, and the like, available in the art, such as, for example, the BLUETOOTH standards developed by the Bluetooth Special Interest Group. As shown in FIG. 7, the wireless communications unit 120 in the control unit 116 provides wireless communications between the audio device 100 and a master device 133 such as a digital music player, a cellular telephone, a computer, or similar electronic device. The master device 133 provides audio data, and control signals, among other communications to the audio device 100 via wireless communications with the wireless communications unit 120 for use by the audio device 100. The audio device 100 may also transmit a variety of communications to the master device 133 via the wireless communications unit 120 like, for example, handshake signaling for creating a secure connection therebetween, audio data collected by the microphone 132, or command signals to the master device 133, e.g. to change an audio file being played, among others.

The processor or logic chip 122 executes one or more programs or routines useable to produce an audible output using audio data received from the master device 133 via the wireless communications unit 120. The processor 122 may process audio inputs received from the microphone 132 for communication to the master device 133. Additionally, one or more control surfaces 134 can be provided on the audio device 100 from which the processor 122 can receive input commands. The control surfaces 134 can include touch interfaces, such as capacitive surfaces, buttons, switches, rotatory dials, or the like and enable a user to provide inputs to the audio device 100 or to the master device 133. In one embodiment, a capacitive touch interface is provided in a base or distal end of the housing 118. In another embodiment, a lower portion of the housing 118 is rotatable with respect to an upper portion or with respect to the body 110 to provide input to the audio device 100 or to the master controller. For example, a user might provide an input to change an audio track being played, to increase a volume of the audio output, or to interact with an application executing on the master device 133.

The on-board memory 124 is useable by the processor 122 for execution of programs and routines but is not configured to provide storage of audio or other data for later playback, e.g. the memory 124 cannot be used to store audio data for a plurality of songs on the audio device 100 for later playback in a manner similar to a digital music player—such tasks are reserved for the master device 133. In another embodiment, the memory 124 can be configured for storage of one or more data or audio files.

The amplifier 130 is employed by the processor 122 to provide outputs useable by a sound-production unit 136 disposed proximate the second end 114 of the body 110. The output of the amplifier 130 comprises electrical signals, which may be amplified, that are communicated to the sound-production unit 136 via an electrical wire or conductor 138 in a known manner. However, the control unit 116 might also be configured to provide outputs to the sound-production unit 136 as air pressure waves carried by a hollow conduit, or as light rays carried by fiber-optic conduits. In one embodiment, the body 110 functions as the electrical wire or conductor 138 (see FIG. 14D) or as the conduit for carrying the pressure waves or optical signals.

The microphone 132 is any available microphone useable to receive audio inputs from a user including, for example, vocalizations provided during a telephone call as well as voice commands to the master device 133 when such capabilities are present in the master device 133. Additional microphones 132 may be provided at disparate locations on the audio device 100 for use in collecting audio inputs from a user's surroundings or environment, such as in the body 110 or in the sound-production unit 136. Such audio inputs are useable by the processor 122 or the master device 133 for noise cancellation among other uses.

Figure 4:
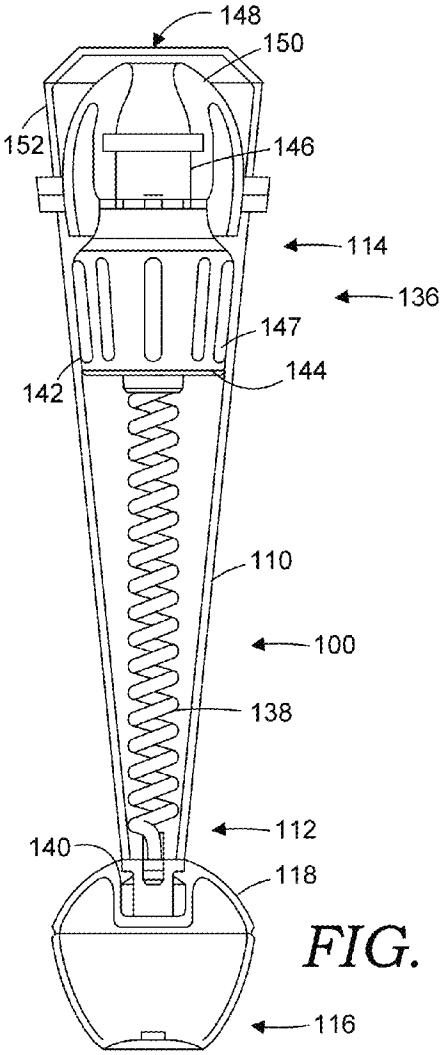
FIG. 4 is an elevational view of the audio device of FIG. 2 depicted with exterior walls removed to reveal components disposed therein.

With continued reference to FIG. 4, the control unit 116 is removably coupled to the first end 112 of the body 110. The coupling can be a threaded coupling provided by mating threads on the first end 112 of the body 110 and a receptacle 140 in the housing 118 of the control unit 116. Or the body 110 and the housing 118 can include any of a variety of mating flanges, tabs, grooves, slots, or the like that enable snap-fit, friction-fit, magnetic fit, or other engageable couplings. The coupling places the control unit 116 in communication with the conductor 138 by, for example, placing metallic contacts on the first end 112 of the body 110 in contact with mating contacts disposed within the receptacle 140 of the housing 118.

Figure 8:
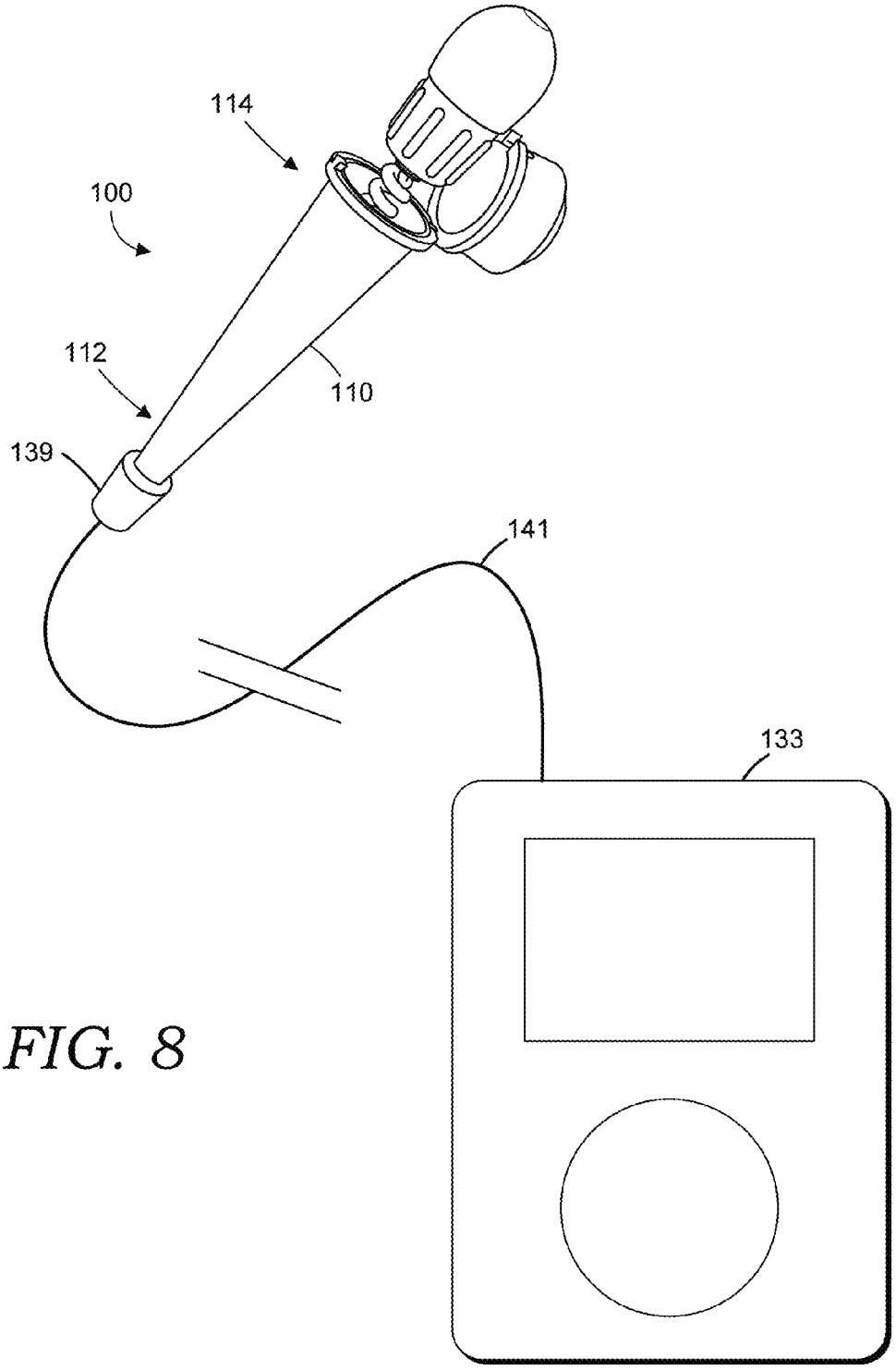
FIG. 8 is a diagrammatic view depicting a wired connection between the audio device of FIG. 2 and a master device in accordance with an embodiment of the invention.
Figure 9:
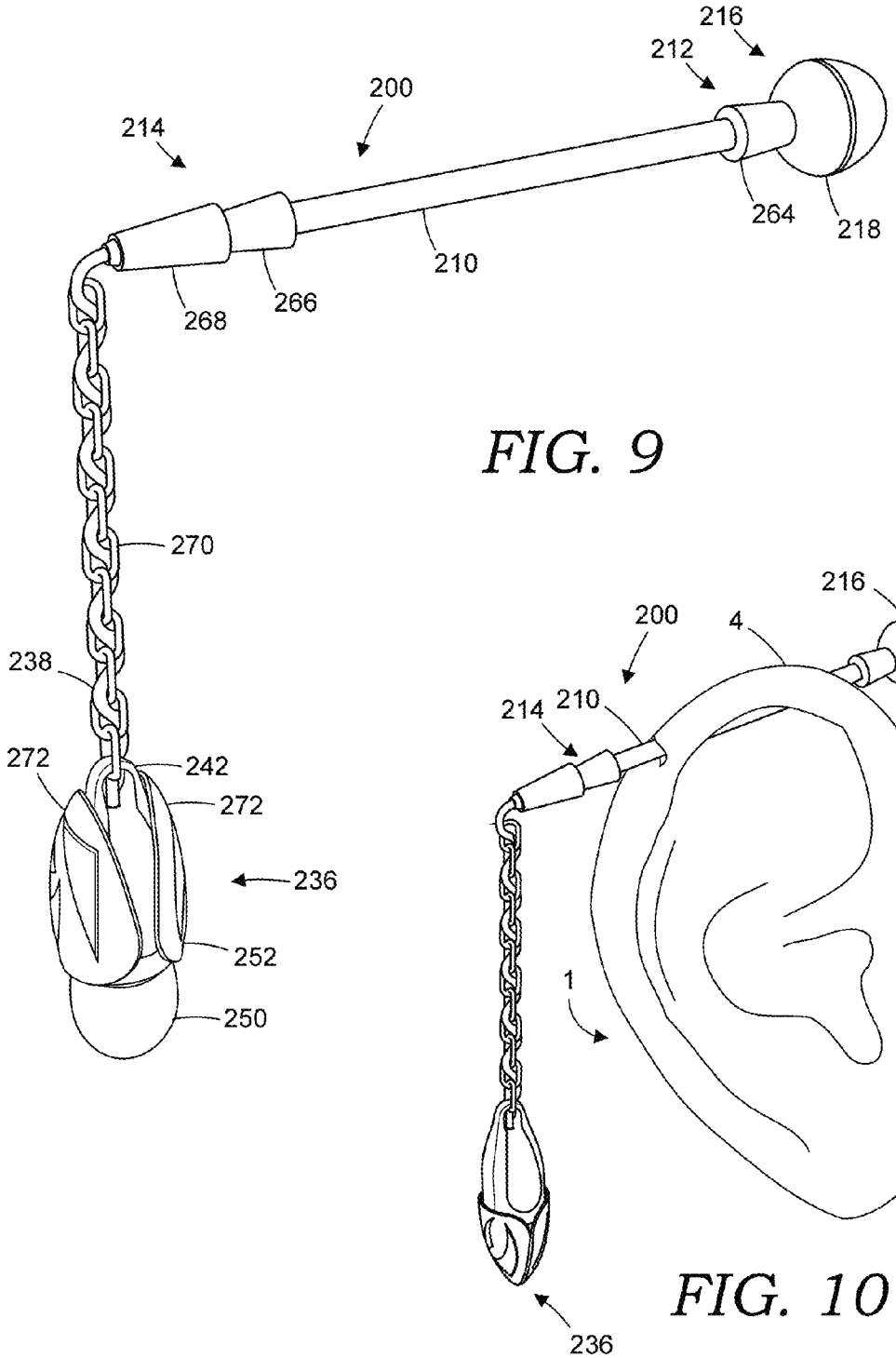
FIG. 9 is a perspective view of an audio device configured as an industrial-style earring depicted in accordance with an embodiment of the invention.

As seen in FIG. 8, the first end 112 of the body 110 may also be configured to receive a wire 141 or other conductor for connection to the master device 133 when the control unit 116 is removed therefrom. The threads, flanges, tabs, or other features on the first end 112 of the body 110 for coupling to the housing 118 of the control unit 116 as well as the contacts for coupling to the conductor 138 can be employed for coupling with a receiver 139 on an end of a wire 141. Such a wired coupling might be employed when wireless communications are restricted, e.g. such as on an airplane, but use of the audio device 100 is desired.

Figure 6:
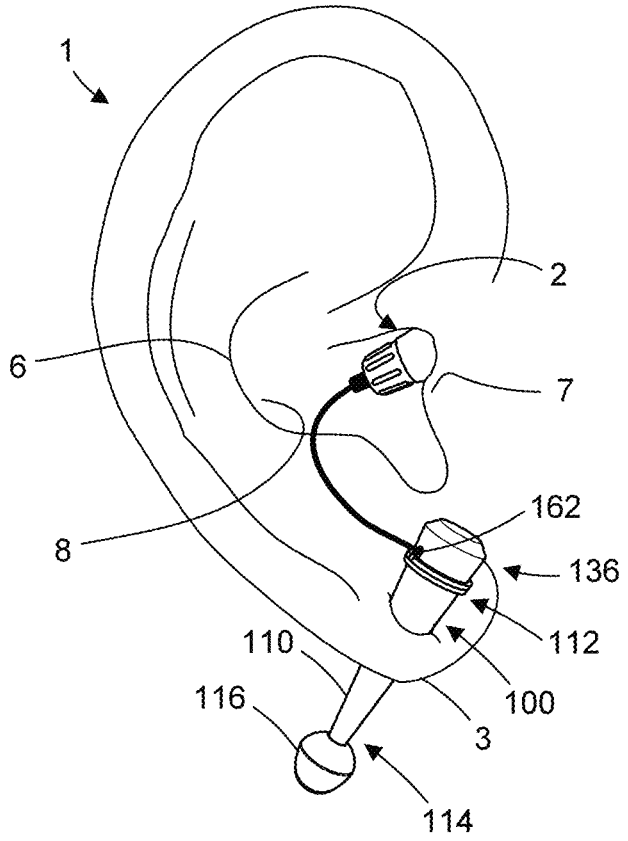
FIG. 6 depicts the audio device of FIG. 2 disposed in a piercing in the lobe of an ear with an audio-production device disposed to direct audio outputs toward the ear canal in accordance with an embodiment of the invention.

Now referring back to FIG. 4, the conductor 138 is coupled to the first end 112 of the body 110 within the interior thereof and extends through the interior of the body 110 toward the second end 114 and couples to the sound-production unit 136. The conductor 138 is flexible and may be extensible to enable the conductor 138 to extend a distance from within the body 110 sufficient to place a distal end of the sound-production unit 136 in proximity to the ear canal 2 of a user wearing the audio device 100 in the pinna 1 of the user's ear. As shown in FIG. 6, the sound-production unit 136 is disposed in the pinna 1 in a space defined by the antihelix 6, concha 8, and tragus 7 and is directed toward or into the ear canal 2.

Figure 3:
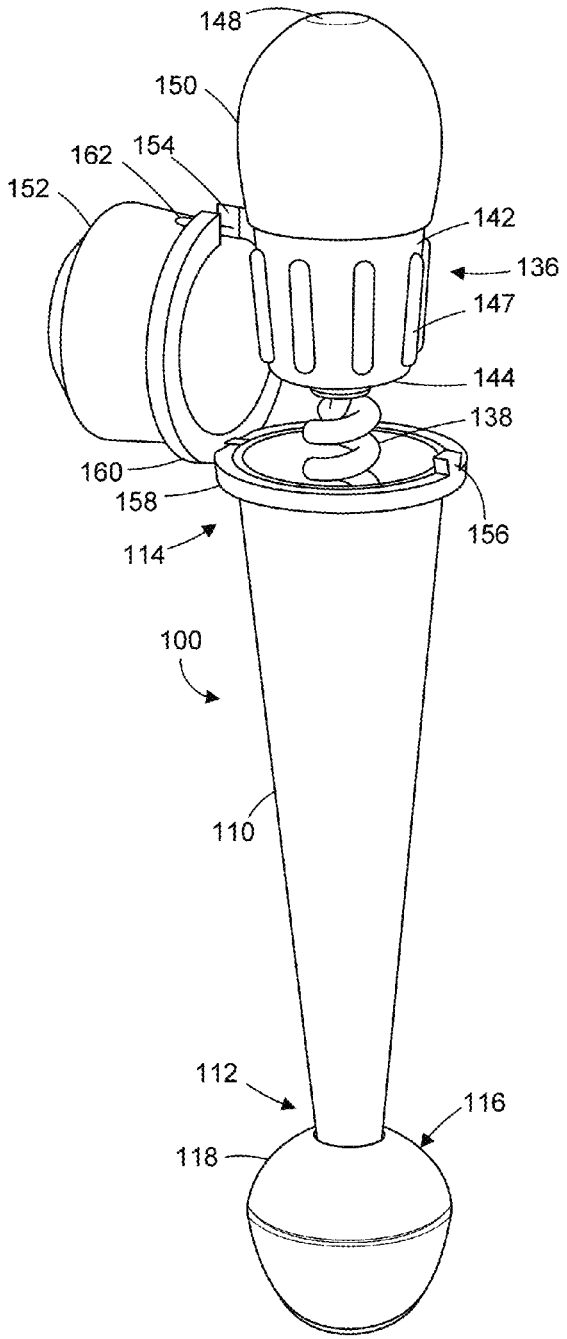
FIG. 3 is a perspective view of the audio device of FIG. 2 depicted with a cover in an open position and a sound-production unit extending from an end of the device.

As depicted in FIGS. 3 and 4 the conductor 138 is provided in a spiral or helical configuration to provide sufficient length to the conductor 138 while also enabling retraction of the conductor 138 into the body 110. The conductor 138 can alternatively be provided in any desired configuration that enables extension and retraction thereof as described herein. For example, the conductor 138 might be disposed on a coil or spool within the body 110 that feeds out the conductor 138 when needed. The conductor 138 may have a memory or may be coated with a resilient coating having a memory to at least partially bias the conductor 138 toward the retracted, spiraled configuration. Such may aid retraction of the conductor 138 into the body 110 when desired. The conductor 138 is flexible and non-supporting in that the conductor 138 has sufficient tensile strength to support the sound-production unit 136 in a suspended or hanging position but has insufficient compressive or flexural strength to support or retain the sound-production unit 136 in positions vertically above the suspended position.

The sound-production unit 136 includes a housing 142 comprising a base 144 with a nipple 146 extending from a distal end thereof. The sound-production unit 136 further includes a speaker, transducer, driver, or other sound production components (hereinafter referred to generally as a speaker) disposed in the housing 142 and configured to produce an audible output. Other components, such as an amplifier, microphone, or the like might also be disposed in the sound-production unit 136.

The base 144 of the sound-production unit housing 142 is configured with a frusto-conical form that is dimensioned to fit within the conical shape of the housing 110 and to be received at least partially therein. As depicted in FIG. 4, the base 144 is received into the body 110 a distance sufficient to leave only a portion of the nipple 146 extending from the body 110. A plurality of ribs 147, ridges, or other protuberances are provided along the perimeter of the base 144. The ribs 147 may provide a friction-fit between the interior of the housing 110 and the housing 142 to removably retain the housing 142 therein as well as provide a cushion between the housing 142 and the body 110. The ribs 147 may also provide an air gap between the housing 142 and the body 110 to avoid the housing 142 becoming stuck in the body 110 as a result of entrapment of air within the body 110. The ribs 147 or similar features might also be configured to provide a snap-fit, mechanical coupling, or magnetic coupling to aid retention of the sound-production unit 136 in the housing 110.

The conductor 138 is coupled to a proximate side of the base 144 of the housing 142 and to the speaker (not shown) or other components disposed therein. In an embodiment, one or more of the components of the control unit 116 may be disposed in the housing 142 and coupled to the conductor 138.

The nipple 146 extends from the distal side of the housing 142 and includes a central aperture 148 through which sound produced by the speaker is directed and emitted from the sound-production unit 136. An exterior of the nipple 146 is configured to removably engage an ear tip 150. Although the nipple 146 is shown and described herein as extending from the distal end of the base 144, such is not intended to so limit embodiments of the invention. For example, the nipple 146 may comprise any structure on the base 144 to which the ear tip 150 may be coupled; the nipple 146 need not necessarily extend from the base 144.

The ear tip 150 comprises a generally dome-shaped portion of a soft, pliable material that surrounds the nipple 146 but does not substantially obstruct the central aperture 148. The ear tip 150 may also be referred to in the art as an earbud, ear plug, ear piece, or the like. The ear tip 150 provides cushioning to produce a comfortable fit for the user when the sound-production unit 136 is at least partially inserted in the pinna 1. The ear tip 150 may also provide some frictional characteristics to aid retention of the sound-production unit 136 in the pinna 1 and/or ear canal 2 as well as blocking of environmental noises or sounds from entering the ear canal 2. The ear tip 150 can be produced in any desired form and from available materials known in the art. For example, the ear tip 150 can be uniquely molded to a particular user's pinna 1, or can be formed from compressible memory-foam, silicon, or rubber materials, among others.

A cover 152 is provided on the second end 114 of the body 110. The cover 152 is pivotally or hingedly coupled to the body 110 to enable pivoting thereof from a closed position (FIGS. 2, 4, and 6) covering and enclosing the sound-production unit 136 within the body 110 and an open position (FIGS. 3 and 7-8) in which the sound-production unit 136 can be removed from within the body 110. In another embodiment, the cover 152 is removably coupled to the body 110 to allow the cover 152 to be detached therefrom.

The cover 152 may include a notch 154 in an edge thereof that is configured to engage a mating tab 156 or flange depending from the perimeter of the second end 114 of the body 110. Annular flanges 158, 160 are provided about the perimeters of the second end 114 of the body 110 and the cover 152, respectively, on which the notch 154 and the tab 156 can be disposed. Frictional, mechanical, and/or magnetic engagement between the notch 154 and the tab 156 releasably retain the cover 152 in the closed position. In another embodiment, a clasp or similar mechanical closure is provided to retain the cover 152 in the closed position.

As shown in FIG. 6, the notch 154 extends a distance along the sidewall of the cover 152 to provide an aperture 162 through which the conductor 138 can be disposed when the sound-production unit 136 is extended from the body 110 and the cover 152 is in the closed position. One of skill in the art will recognize other ways or forms of providing the described features; such other forms are understood as being within the scope of embodiments of the invention described herein.

With continued reference to FIGS. 2-8, operation of the audio device 100 is described in accordance with an embodiment of the invention. The audio device 100 is installed in a piercing in the pinna 1 of the user's ear as depicted in FIG. 6. In some embodiments, two of the audio devices 100 are worn simultaneously, one in each ear of the user, to provide audio outputs to each ear, such as to provide stereo sound. When the audio device 100 comprises a taper-style earring, as described previously, the audio device 100 is usually installed in a piercing in the lobe 3 of the ear. The control unit 116 is removed from the first end 112 of the body 110 and the body 110 inserted through the piercing. The audio device 100 is typically positioned with the first end 112 extending through the lobe 3 to a position between the ear and the head of the user although the reverse placement can be employed. The control unit 116 is recoupled to the body 110. Or a receiver 139 of a wired connection 141 can be coupled to the first end 112 of the body 110 and connected to the master device 133 as shown in FIG. 8.

The audio device 100 is thereby substantially captured by the interaction of the conical form of the body 110 and the enlarged dimensions of the housing 118 of the control unit 116. The dimensions of the second end 114 of the body 110 and of the housing 118 are preferably larger than that of the piercing into which the audio device 100 is inserted. The audio device 100 can be drawn at least partially through the piercing to at least partially stretch the lobe 3 and thereby provide some frictional engagement therebetween. The annular flange 158 on the body 110 can provide an additional obstruction to passage of the second end 114 of the body 110 through the piercing.

The cover 152 is pivoted to the open position and the sound-production unit 136 is withdrawn from within the body 110. The sound-production unit 136 is extended from the body 110 and placed at least partially into a space in the pinna 1 proximate the ear canal 2 and defined by the by the antihelix 6, concha 8, and tragus 7 and directed toward the ear canal 2 of the user. The sound-production unit 136 may be inserted at least partially into the ear canal 2. The conductor 138 extends from the sound-production unit 136, into the body 110 and to the first end 112 thereof to communicatively couple with the control unit 116. The cover 152 can be returned to the closed position with the conductor 138 disposed in the aperture 162. As such, the audio device 100 retains an attractive ornamental appearance of an earring during use for production of audio outputs from the sound-production unit 136.

An initial setup of the audio device 100 with the master device 133 may be carried out. The setup may include a series of communications between the audio device 100 and the master device 133 to complete processes, such as pairing among others known in the art for providing wireless communications between such devices. Description of such processes is not necessary for an understanding of embodiments of the invention and is thus not provided herein.

Using the master device 133 the user selects an audio file or track to be played by the master device 133. The master device 133 wirelessly (or through the wired connection 141) transmits or streams the audio file to the audio device 100 via the wireless communications unit 120. The wireless communications unit 120 receives the audio file for use by the control unit 116 to generate signals to the sound-production unit 136 for production of an audible output therefrom. As such, the signal path of signals embodying the audio file received from the master device 133 travels from a first side of the pinna 1, through the body 110 of the audio device 100 and thus through the pinna 1, and through the conductor 138 to the space proximate the ear canal 2 or in the ear canal 2 where the audio output is finally provided.

The user might alternatively employ the control surfaces 134 on the audio device 100 to instruct the master device 133 to begin playing a desired audio track, skip to a next or a previous track, pause, rewind, fast-forward, or stop playing an audio track. The user might also use the control surfaces 134 to navigate menus, interact with software applications, answer incoming telephone calls, provide voice commands, or the like.

When use of the audio device 100 to provide an audio output is not desired, the sound-production unit 136 and conductor 138 are returned to the body 110 and the cover 152 moved to the closed position. As such, the audio device 100 is wearable as an ornamental earring. The body 110, housing 118 of the control unit, and cover 152 can include any desired exterior ornamentation to enhance the appearance of the audio device 100. When not in use for audio output production, the sound-production unit 136 is completely enclosed and hidden from view.

Figure 10:
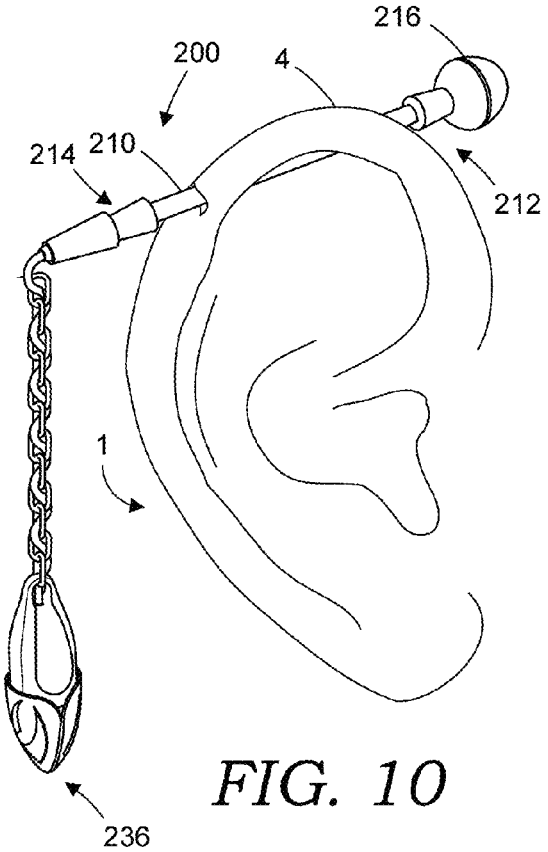
FIG. 10 depicts the audio device of FIG. 9 disposed in a pair of piercings in the helix of an ear in accordance with an embodiment of the invention.
Figure 11:
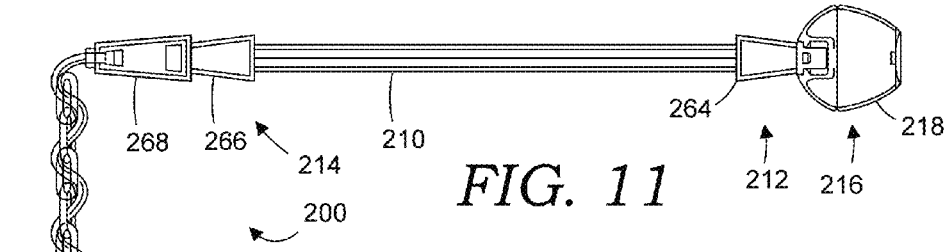
FIG. 11 is an elevational view of the audio device of FIG. 9 depicted with exterior walls removed to reveal components disposed therein.

With reference now to FIGS. 9-12, an audio device 200 is described in accordance with another embodiment of the invention. The audio device 200 is configured as an industrial-style earring. Industrial-style earrings are typically inserted through a pair of piercings in the helix 4 or other cartilaginous portions of the pinna 1, as shown in FIG. 10. The body 210 of the audio device 200 comprises an elongate cylindrical form with first and second connectors 264, 266 disposed at the first and second ends 212, 214 thereof, respectively. The first connector 264 removably couples the body 210 with the control unit 216 and the second connector 266 removably couples the second end 214 of the body 210 with the conductor 238 in a manner similar to that described above with respect to the audio device 100 for connecting the first end 112 of the body 110 with the control unit 116.

The first and second connectors 264, 266 are conical members having a diameter that is larger than the diameter of the body 210, but in other embodiments can have another shape and dimension. As such, when installed in the pinna 1 of the user, the first and second connectors 264, 266 may act to obstruct passage of the body 210 through the piercings. One or both of the first and second connectors 264, 266 may also be removably coupled to the body 210 to enable removal thereof for installation of the body 210 in the pinna 1. Alternatively, the conical shape of the connectors 264, 266 may aid insertion of the connectors 264, 266 and the body 210 through the piercings by stretching of the piercings.

The conductor 238 of the audio device 200 includes a receiver 268 at one end thereof that couples the conductor 238 to the second connector 266 and thus, to the body 210 which forms or provides a second segment of the conductor 238 extending through or along the body 210. The sound-production unit 236 is coupled to the opposite end of the conductor 238 and thus is suspended from the second end 214 of the body 210 via the conductor 238. The second segment of the conductor 238 thus continues the path of the conductor 328 between the sound-production unit 236 and the control unit 216 or to a wired coupling with a master device (see the wired coupling 141 and the master device 133 depicted in FIG. 8).

Figure 14A:
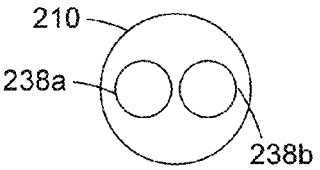
FIG. 14A depicts a positive and negative element of a conductor disposed interior to a body of an audio device in accordance with an embodiment of the invention.
Figure 14C:
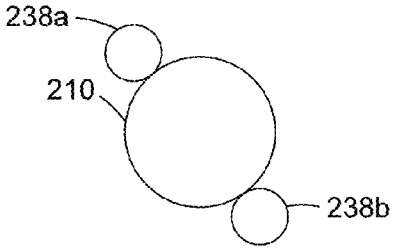
FIG. 14C depicts a positive and negative element of a conductor disposed on an exterior surface of a body of an audio device in accordance with an embodiment of the invention.
Figure 14B:
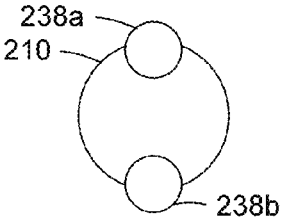
FIG. 14B depicts a positive and negative element of a conductor disposed within a wall of a body of an audio device in accordance with an embodiment of the invention.
Figure 14D:
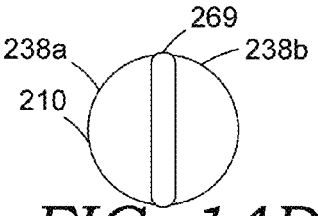
FIG. 14D depicts sidewalls of a body of an audio device forming positive and negative element of a conductor in accordance with an embodiment of the invention.

As shown in FIGS. 14A-D, the second or other segments of the conductor 238 can take a variety of configurations. For example, FIG. 14A depicts a positive and negative conductor 238*a*, 238*b* disposed interior to the body 210 and FIG. 14B depicts the positive and negative conductors 238*a*, 238*b* disposed in a wall of the body 210. FIG. 14C shows the conductors 238*a*, 238*b* disposed on an exterior surface of the body 210 and in FIG. 14D depicts sidewalls of the body 210 functioning as the conductors 238*a*, 238*b* with an insulating member 269 disposed therebetween. It is to be understood that such configurations can also be employed in other configurations of the audio device 200, such as in the audio device 100 discussed previously.

A chain 270 or other non-extensible member can be intertwined with, disposed alongside, or otherwise associated with the conductor 238. The chain 270 may provide additional support for the sound-production unit 236 as it is suspended and/or may be provided to enhance aesthetic qualities of the conductor 238. The chain 270 may be coupled to the receiver 268 and to the base 244 of the housing 242.

Figure 13:
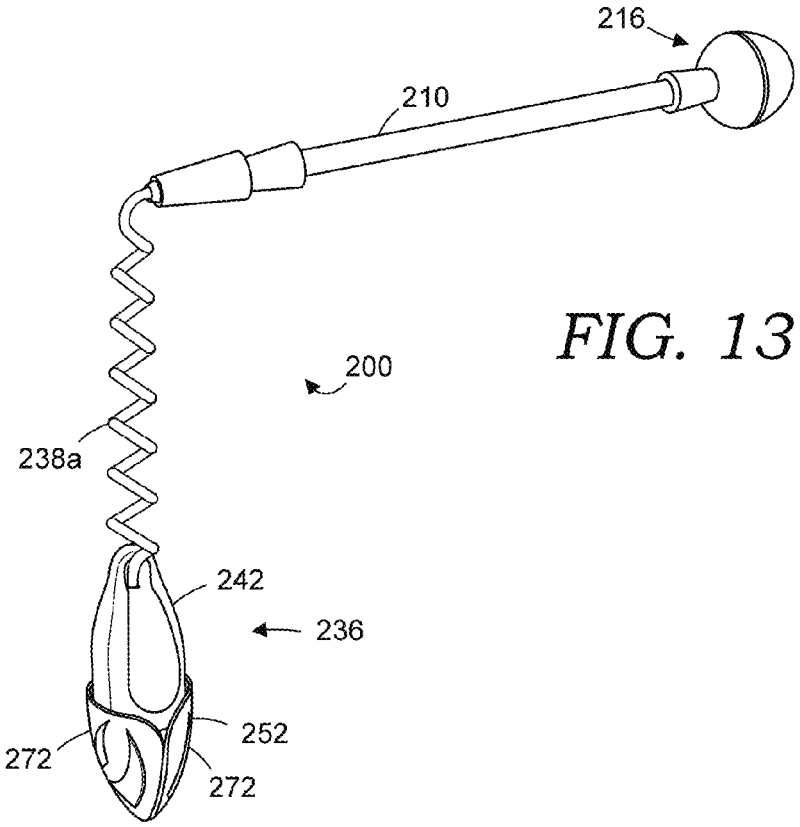
FIG. 13 is a perspective view of an audio device configured as an industrial-style earring with an extensible conductor configured in a helical form and coupling a body with a sound-production unit of the audio device in accordance with an embodiment of the invention.

As shown in FIG. 13, a conductor 238*a* may comprise a resilient or extensible conductor 238*a* that has a shape memory. The conductor 238*a* has a helical or spiral form that can be elongated by pulling or stretching the conductor 238*a*. When released the conductor 238*a* will substantially resume its previous form.

Figure 12:
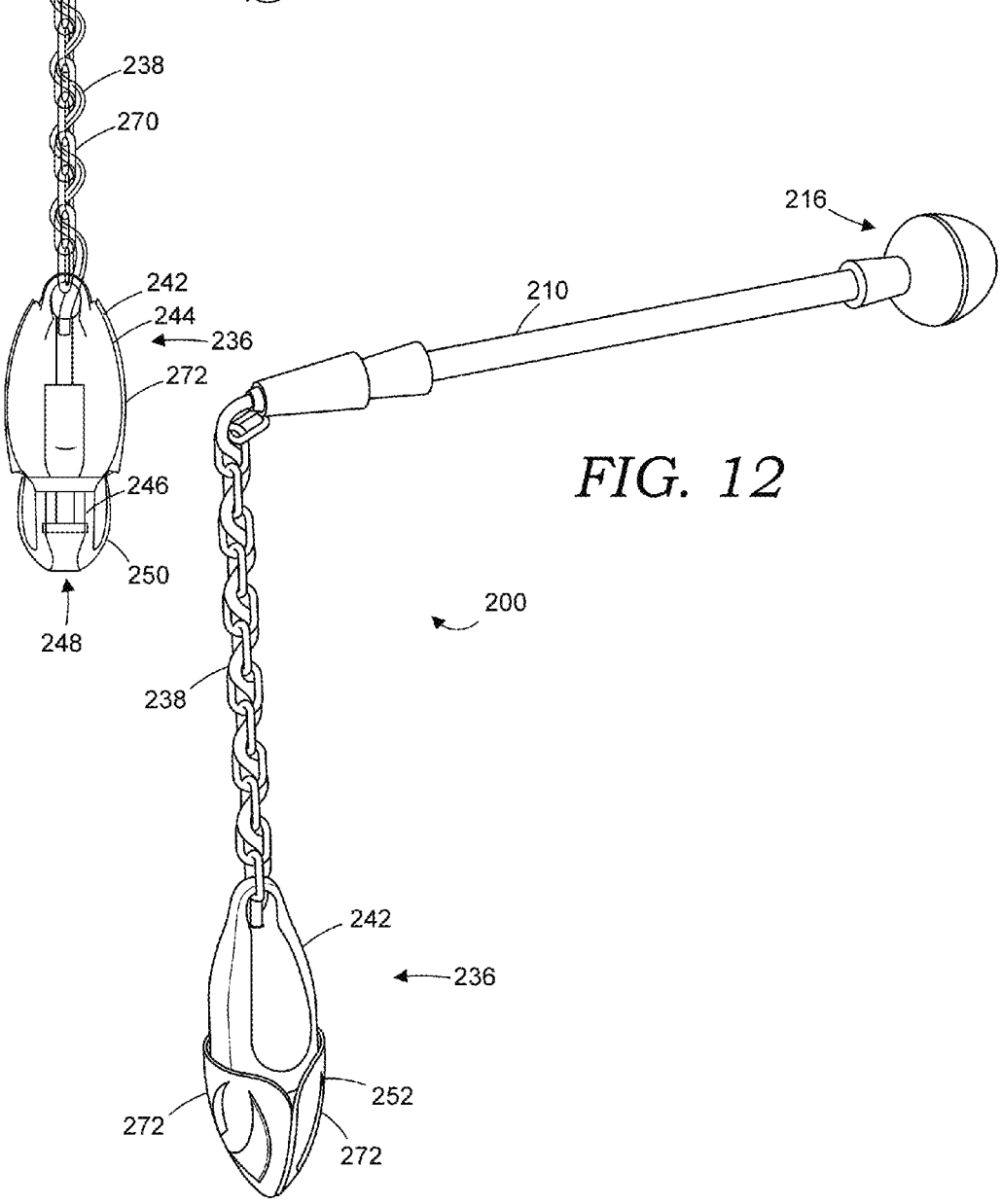
FIG. 12 is a perspective view of the audio device of FIG. 9 depicting a cover enclosing a sound-production unit.

The cover 252 comprises a pair of actuatable halves, shells, or leaves 272 that are moveable from a use position (FIGS. 9 and 11) to a non-use position (FIGS. 10 and 12). In the use position, the leaves 272 are disposed alongside the base 244 of the housing 242 to expose the ear tip 250 and not interfere with insertion thereof into the ear canal 2 of the user. The leaves 272 are shaped to generally mimic the shape of the ear tip 250 and the base 244 of the housing 242. As such, the leaves 272 can lie substantially alongside and in close proximity to the sides of the base 244. In the non-use position, the leaves 272 are rotated or pivoted to extend toward a distal end of the sound-production unit 236 and to substantially enclose the ear tip 250 therebetween. In another embodiment, the cover 252 comprises a cap that is mechanically or magnetically coupled to the housing 242 and may be removable therefrom. Embodiments of covers for ear tips are described more fully below with respect to FIGS. 20-46.

In use, the audio device 200 is disposed in the pinna 1 of the user's ear, as depicted in FIG. 10. When use of the audio device 200 for audio output is desired, the leaves 272 are rotated from the non-use position to the use position to expose the ear tip 250. The sound-production unit 236 is placed in the space proximate to the ear canal 2 and the audio device 200 is operated as described previously above with respect to the audio device 100. As such, the signal path of signals embodying the audio file received from the master device 233 travels from a first side of the pinna 1 through the body 210 of the audio device 200 and thus passes through the pinna 1 two times before passing through the conductor 238 to the space proximate the ear canal 2 where the audio output is finally provided.

When use of the audio device 200 for audio output is no longer desired, the sound-production unit 236 is removed from the space proximate the ear canal 2 and the leaves are returned to the non-use position. The sound-production unit 236 is then allowed to dangle or suspend from the second end of the body 210, as shown in FIG. 10. The housing 242, the leaves 272, and the chain 270 may be provided with an ornamental appearance to enhance the attractiveness of the audio device 200 as an earring. If desired, one or both of the conductor 238 with the sound-production unit 236 and the control unit 216 can be removed from the body 210 and the body 210 worn alone as an earring.

Figure 15:
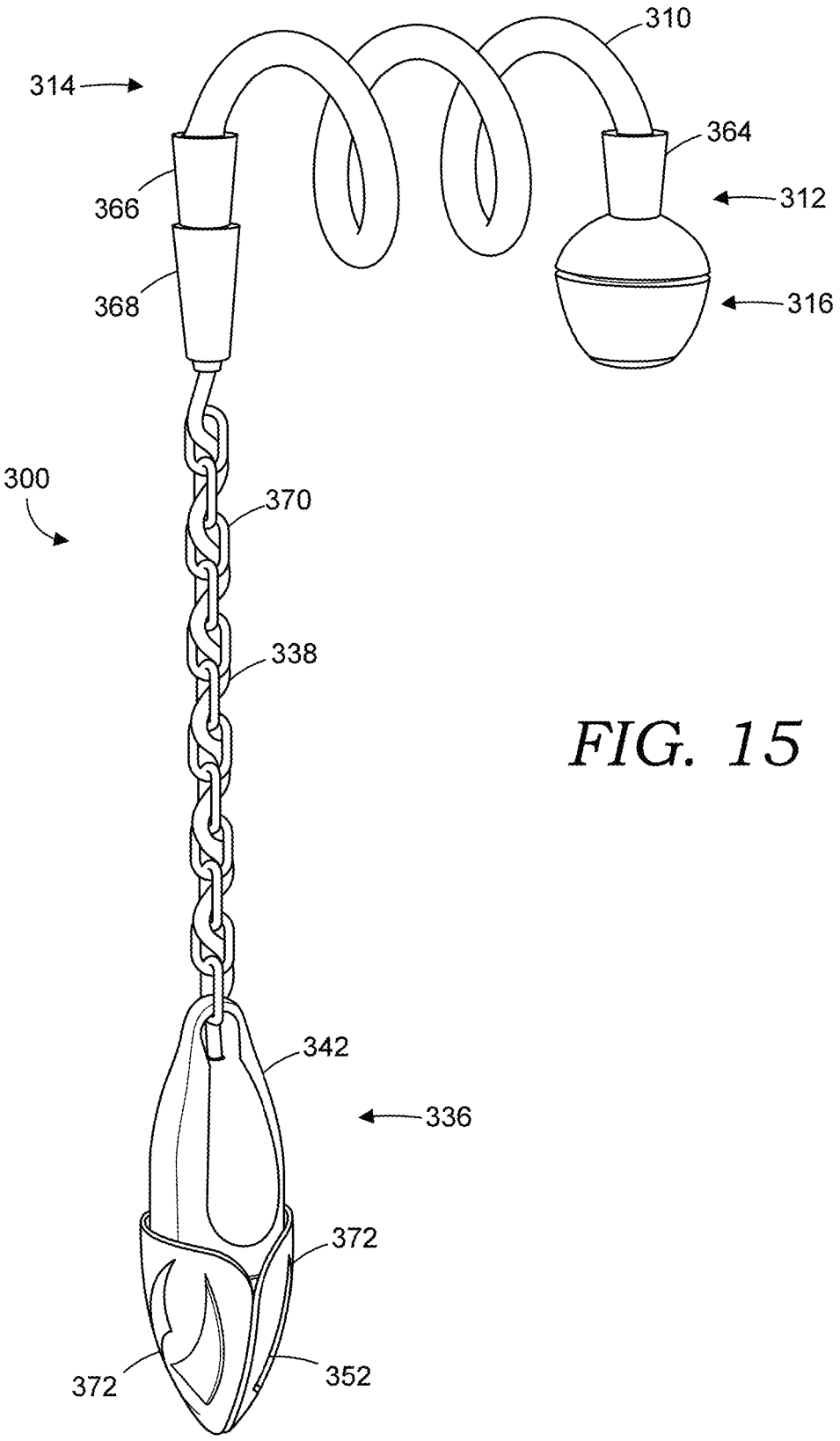
FIG. 15 is a perspective view of an audio device configured as a swirl-style earring depicted in accordance with another embodiment of the invention.
Figure 16:
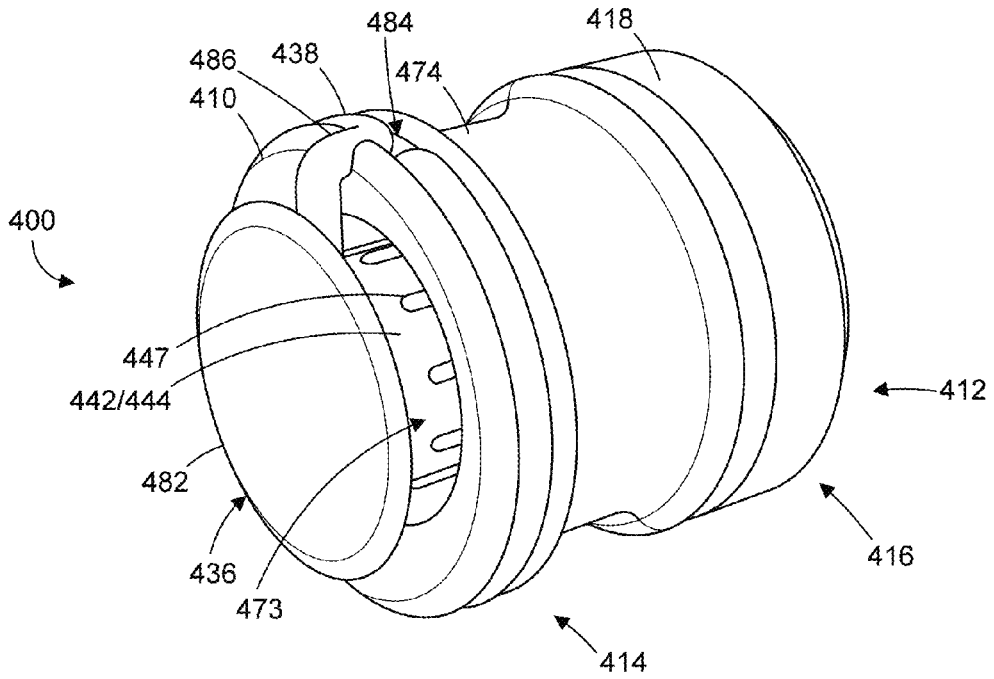
FIG. 16 is a perspective view of an audio device configured as a gauge-style earring depicted in accordance with an embodiment of the invention.
Figure 17:
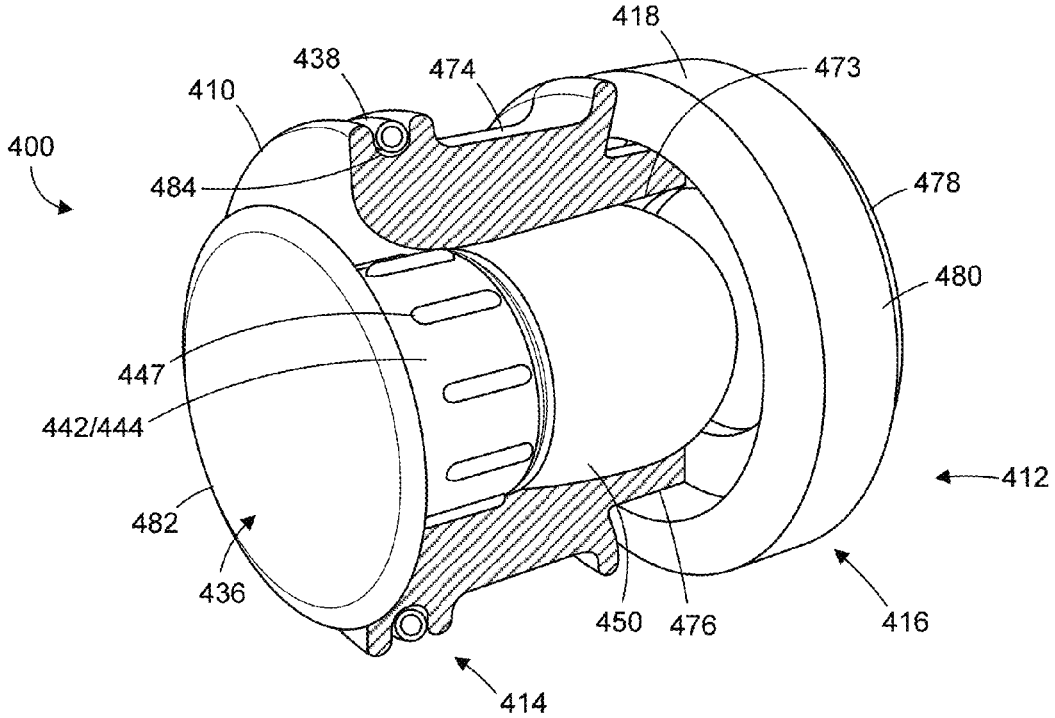
FIG. 17 is a partial cross-sectional view of the audio device of FIG. 16.

Referring now to FIG. 15, an audio device 300 is described in accordance with an embodiment of the invention. The audio device 300 is configured as a spiral-type earring. The spiral-type is similar to the industrial-type except for the body 310 thereof being provided in a spiraling or helical form. Features and operation of the audio device 300 correspond to those of the audio device 200 described previously above and are thus not described further here.

With additional reference now to FIGS. 20-46, the sound-production unit 236 useable with the audio devices 200 and 300 may take a variety of forms. Embodiments of the sound-production unit 236 are described hereinafter using 200 series reference numerals, however such is not intended to limit use of the described sound-production units to the audio device 200; the described sound-production units 236, 236', 236", 236''' are equally usable in embodiments of the audio device 300.

FIGS. 20-26, depict the sound-production unit 236 with the cover 252 comprising a pair of rotatable leaves 272 as described previously above. The housing 242 provides a pair of receivers 275 disposed diametrically opposite one another on the housing 242. Each of the receivers 275 is configured to receive a stud 277 extending from an interior surface of a respective one of the leaves 272. The stud 277 is rotatable within the receiver 275 to enable the respective leaf 272 to rotate relative to the housing 242 about an axis extending through the receiver 275 between the use and non-use positions. The stud 277 is generally fixed against axial movement within the receiver. The leaves 272 are independently moveable between the use and non-use positions or may be mechanically coupled within the housing 242 to enable movement of one leaf 272 to cause simultaneous and mirroring movement of the opposite leaf 272.

One or more soft-stops may be provided between the leaf 272 and the housing 242 to aid retention of the leaves 272 in one or more rotational orientations relative to the housing 242, e.g. to retain the leaves 272 in the use and non-use orientations. For example, the stud 277 or the leaf 272 may be provided with a nub that engages a detent on the receiver 275 or the housing 242 to releasably lock the leaf 272 in either the use or the non-use position. A separate detent may be provided for locking the leaf 272 into each of the use and non-use positions. The stud 277 and/or the leaf 272 may at least partially flex to allow engagement with such detents.

In another embodiment, the stud 277 is able to move at least a short axial distance within the receiver 275 and a coil spring (not shown) might be provided between the leaf 272 and the receiver 275 or the housing 242. The stud 277 is thereby biased into the receiver 275 by the spring and thus the nub associated therewith is biased into engagement with the detent. The leaf 272 or stud 277 can be pulled away from the housing 242 a distance sufficient to disengage the nub from the detent and to thereby allow rotation of the leaf 272 between the use and non-use positions. The nub, detent, and coil spring are not shown in the drawings so as not to obscure other features shown therein. It is understood that the nub/detent combination may be reversed to place the nub on the receiver 275 or housing 242 and the detent on the stud 277 or leaf 272.

Figure 27:
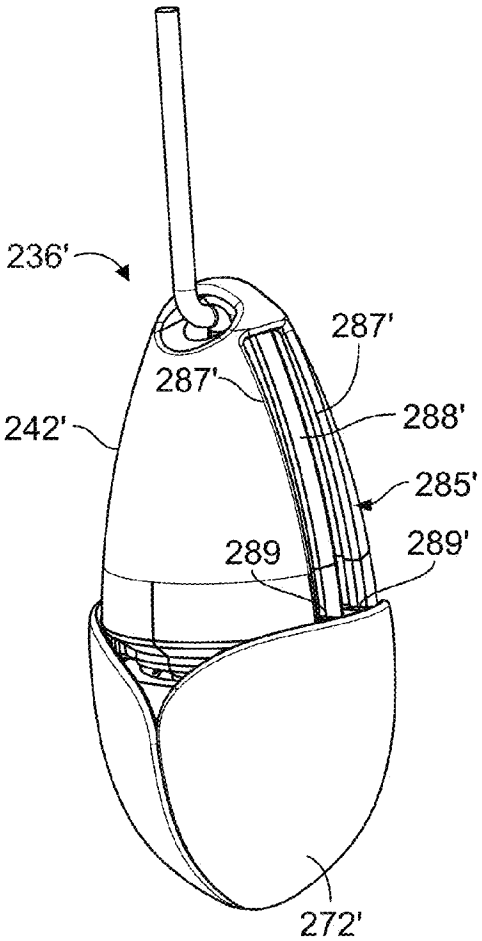
FIG. 27 is a perspective view of a sound-production unit with sliding leaves shown in a non-use orientation and depicted in accordance with an embodiment of the invention.
Figure 30:
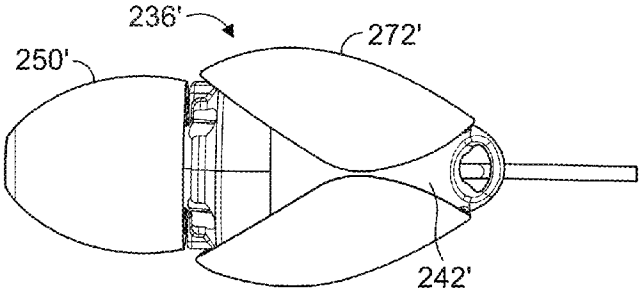
FIG. 30 is a first side elevational view of the sound-production unit of FIG. 28.
Figure 29:
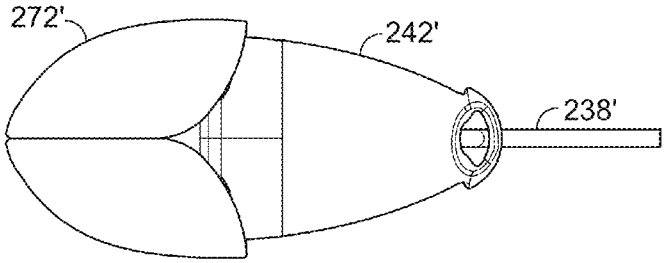
FIG. 29 is a first side elevational view of the sound-production unit of FIG. 27.

With additional reference now to FIGS. 27-34, a sound-production unit 236' is described in accordance with another embodiment of the invention. In the sound-production unit 236' the leaves 272' are retractable from the use position to the non-use position by sliding longitudinally along the housing 242'. The housing 242' includes a pair of recessed tracks 285 extending longitudinally along diametrically opposing sides of the housing 242'. As depicted in FIGS. 27 and 34, the track 285 includes two parallel and spaced apart channels 287 with a ridge 288 therebetween. As shown in FIG. 34, the channels 287 have an L-shaped cross-section with a first arm 287*a* of the L-shape extending inward into the housing 242' and a second arm 287*b* extending transversely away from the ridge 288 and the adjacent channel 287.

Each of the leaves 272' includes a pair of legs 289 extending from an interior surface and near a rearward end thereof. The legs 289 are positioned side-by-side and spaced apart a distance sufficient to engage respective ones of the channels 287. Each leg 289 extends generally orthogonally from the interior surface of the leaf 272' a distance sufficient to engage the first arm 287*a* of the respective channel 287 and then turns outwardly away from the ridge 288 to form a foot 289*a* that engages the second arm 287*b* of the channel 287. Although pairs of channels 287 and legs 289 are described herein, it is understood that more or fewer channels 287 and legs 289 might be employed in embodiments of the invention without departing from the scope of described herein.

Figure 33:
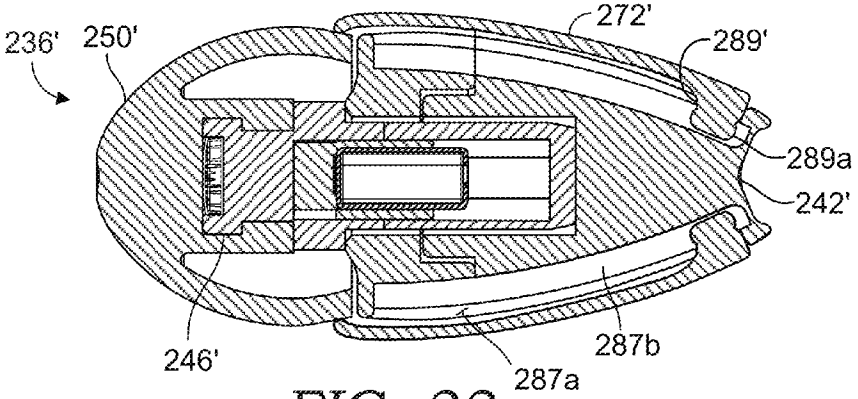
FIG. 33 is a cross-sectional view of the sound-production unit of FIG. 31 taken along the line 32-32 shown in FIG. 31 but with the leaves in a use orientation and depicted in accordance with an embodiment.

As depicted in FIGS. 33 and 34, the foot 289*a* of each leg 289 has an oblong or generally rectangular cross-sectional shape with the long dimension thereof extending generally parallel to the length of the channel 287. The thickness or height of the second arm 287*b* of the channel 287 is dimensioned to receive the smaller dimension of the foot 289*a* but not the longer dimension. As such, the foot 289*a* is permitted to slide in the longitudinal direction of the channel 287, but is substantially held against rotation of the foot 289*a* within the second arm 287*b* of the channel 287. The respective leaf 272' is thus enabled to slide or move along the exterior of the housing 242' between the use and non-use positions but is retained against pivotal movement away from the housing 242' about the feet 289*a*.

With reference now to FIGS. 35-40, a sound-production unit 236" includes a generally cylindrical speaker housing 242" with a cover 252" comprising a tube that has one open end and an opposite second end that includes an endwall 290" extending thereacross. The speaker housing 242" and the tubular cover 252" are dimensioned to enable the speaker housing 242" to fit within the tubular cover 252" and to move coaxially within the tubular cover 252". Although the speaker housing 242" and the tubular cover 252" are shown and described herein having generally circular cross-sectional shapes, other cross-sectional shapes that allow the speaker housing 242" to fit and move coaxially within the tubular cover 252" may be employed. The endwall 290" of the cover 252" includes a central aperture 291" through which the conductor 238" coupling the sound production unit 236" to the remainder of the audio device 200" extends from the tubular cover 252".

The ear tip 250" is formed from a generally pliable or resilient rubber, plastic, silicon, or similar elastomeric-type material and has generally tubular shape with a first end and a second end. The first end of the ear tip 250" is dimensioned to fit within and to couple to an interior surface of the tubular cover 252" at the open end thereof. The interior surface of the open end of the tubular cover 252" may include a recess 299" configured to receive the first end of the ear tip 250". The first end of the ear tip 250" may be coupled to the tubular cover 252" using one or more of glues, adhesives, welding, mechanical engagement, fasteners, or the like.

The generally tubular shape of the ear tip 250" expands radially outward from the first end to form an enlarged, generally dome-shaped body before gradually reducing in diameter toward a distal end thereof. The second end of the ear tip 250" is turned inward to extend within the enlarged body toward and in the same direction as the first end. The second end of the ear tip 250" engages the nipple 246" of the speaker housing 242" which extends from the open end of the tubular cover 252" into the enlarged body of the ear tip 250". The second end of the ear tip 250" couples around the circumference of the nipple 246" leaving an open pathway 292" through which sound may be directed from the speaker housing 242". The second end of the ear tip 250" may include an annular flange 293" that engages an annular trough 294" provided on the nipple 246". One or more of glues, adhesives, welding, fasteners, or the like may be employed to couple the second end of the ear tip 250" to the nipple 246".

Axial or telescopic movement of the speaker housing 242" within the tubular cover 252" enables transitioning the sound production unit 236" between the use orientation shown in FIGS. 36, 38, and 40, and the non-use orientation shown in FIGS. 35, 37, and 39. In the use orientation, the speaker housing 242" may be partially extended from the tubular cover 252" and the ear tip 250" is fully expanded to enable insertion of the ear tip 250" into the pinna 1, or more specifically, at least partially into the ear canal 2 of a user for listening to audio produced by the sound production unit 236".

To place the sound production unit 236" into the non-use orientation, the speaker housing 242" is moved into the tubular cover 252" toward the endwall 290". The speaker housing 242" can be moved by pulling the conductor 238" through the aperture 291" in the endwall 290" to draw the speaker housing 242" into the interior of the tubular cover 252" or by applying a force on the ear tip 250" or the nipple 246" directed toward the endwall 290". By either method, the speaker housing 242" moves toward the endwall 290" and draws the second end of the ear tip 250" into the tubular cover 252" along with it. The first end of the ear tip 250" remains in engagement with the tubular cover 252" and is thus moved away from the speaker housing 242" as the speaker housing 242" moves toward the endwall 290". The ear tip 250" is thus substantially inverted or turned inward on itself and lies substantially within the tubular cover 252". In one embodiment, the conductor 238" may be reinforced or another structure may be provided to aid pulling the speaker housing 242" into the tubular cover 252" without damaging the conductor 238". Such reinforcement or additional structure may also aid to push the speaker housing 242" through the tubular cover 252" to move to the use orientation. For example, a reinforcing sleeve (not shown) might be provided around a portion of the conductor 238", or an elongate, semi-rigid tab (not shown) might be provided to extend generally parallel to and alongside the conductor 238" that can be employed to move the housing 242" relative to the cover 252".

In the non-use orientation, the ear tip 250" is elongated and drawn into the tubular cover 252". The enlarged body thereof is thus deformed through the elongation thereof to fit within the diameter and length of the tubular cover 252". The material comprising the ear tip 250" may include sufficient shape memory to cause the ear tip 250" to resume its original form when the sound production unit 236" is again placed in the use orientation. In another embodiment, the ear tip 250" is caused to resume the original shape by forces applied thereon resulting from coupling of the first and second ends thereof to the tubular cover 252" and the nipple 246" respectively.

In the non-use orientation the ear tip 250" and the speaker housing 242" are protected from damage and hidden from view by the tubular cover 252". The tubular cover 252" can be provided with any desired ornamental decoration, exterior shape, or dimensions to enhance the aesthetic appearance thereof.

Referring now to FIGS. 41-46, a sound-production unit 236'" is described in accordance with an embodiment of the invention. The sound-production unit 236'" can be used with and coupled to the first or second connectors 264, 266 on the body 210 configured as an industrial, swirl, or other style piercing. The sound-production unit 236'" includes a speaker housing 242'" that is removeably insertable into a cover 252'".

The cover 252'" includes an interior hollow 295'" shaped and dimensioned to receive the speaker housing 242'", including the ear tip 250'", in a generally form fitting manner. As depicted in FIGS. 41-46, the speaker housing 242'" and ear tip 250'" are directed generally downward within the cover 252'" however, other orientations may be employed. The interior hollow 295'" is open for receipt of the speaker housing 242'" along a side of the cover 252'". The speaker housing 242'" is inserted in a downward and inwardly rotating manner to place the center of gravity of the speaker housing 242'" generally centrally within or just beyond the center of the interior hollow 295'" of the cover 252'" to aid retention of the speaker housing 242'" therein. In one embodiment, the interior hollow 295'" is sized just smaller than the ear tip 250'" in at least one dimension. As such the ear tip 250'" is at least partially compressed in at least one dimension to provide a frictional engagement between the ear tip 250''' and an interior surface of the interior hollow 295''' to aid retention of the ear tip 250''' in the interior hollow 295'''.

The speaker housing 242''' includes an exposed surface 296''' that is exposed to view when the speaker housing 242''' is installed in the cover 252'''. The exposed surface 296''' and the exterior of the cover 252''' may include any desired ornamentation and form to enhance the aesthetic appearance thereof. The speaker housing 242''' and/or the exposed surface 296''' may include one or more features, such as flanges, ribs, tabs, ridges, or the like that aid retention of the speaker housing 242''' in the cover 252''' and/or aid to disguise an interface therebetween that may be visible from the exterior of the sound-production unit 236'''.

As shown in FIGS. 41-42 and 45-56, the cover 252''' may include a channel 297''' extending from the interior hollow 295''' to a location adjacent a coupling loop 298''' in which the conductor 238''' extending between the speaker housing 242''' and the remainder of the audio device 200''' can be disposed. The channel 297''' may be configured to receive a single run of the conductor 238''' or the channel 297''' can be configured to receive a plurality of runs of the conductor 238''', for example by folding the conductor 238''' back-and-forth along the channel 297'''. A portion of the conductor 238''' may also be disposed within the interior hollow 295''' alongside the speaker housing 242''' and/or ear tip 250'''. The channel 297''' may be dimensioned to retain the conductor 238''' therein by friction fit and/or may include features such as ridges, coatings, pads, or the like to aid retention of the conductor 238''' therein. The length of conductor 238''' and thus the configuration of the channel 297''' may be determined based on a desired length of the conductor 238''' needed to enable insertion of the ear tip 250''' into the ear canal 2 of the user.

The sound-production unit 236''' thus includes a use and a non-use orientation. In the use orientation, generally shown in FIGS. 42, 44, and 46, the speaker housing 242''' is removed from the cover 252''' by pivoting the speaker housing 242''' outwardly and withdrawing the ear tip 250''' from the interior hollow 295''' of the cover 252'''. For example, the speaker housing 242''' may pivot or rotate about an edge of cover 252'''. The ear tip 250''' can then be moved to place the ear tip 250''' into the pinna 1 and/or the ear canal 2 of the user for listening to audio produced by the audio device 200'''. Movement of the speaker housing 242''' away from the cover 252''' also withdraws the conductor 238''' from the channel 297''' to provide sufficient slack for positioning the ear tip 250''' in the user's ear canal 2.

When removed from the ear canal 2 the sound-production unit 236''' is placed in the non-use orientation (depicted in FIGS. 41, 43, and 45) by inserting the ear tip 250''' into the interior hollow 295''' and at least partially rotating the speaker housing 242''' toward the cover 252'''. The conductor 238''' may also be installed into the channel 297''' by pressing into place or may naturally fall or move into the channel 297''' when the speaker housing 242''' is inserted into the interior hollow 295'''. As such, the ear tip 250''' is hidden from view by the cover 252''' and the exposed surface 296''' of the speaker housing 242'''. The cover 252''' and the exposed surface 296''' may be provided with any desired ornamentation to disguise the identity of the sound-production unit 236''' as such and to provide the appearance thereof as being jewelry.

Figure 18:
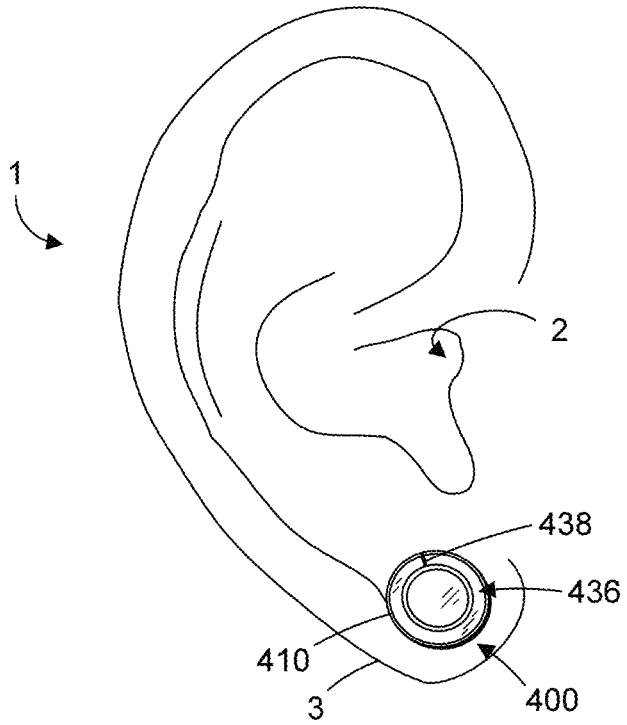
FIG. 18 depicts the audio device of FIG. 16 disposed in a piercing in a lobe of an ear with a sound-production unit in a stowed position in accordance with an embodiment of the invention.
Figure 19:
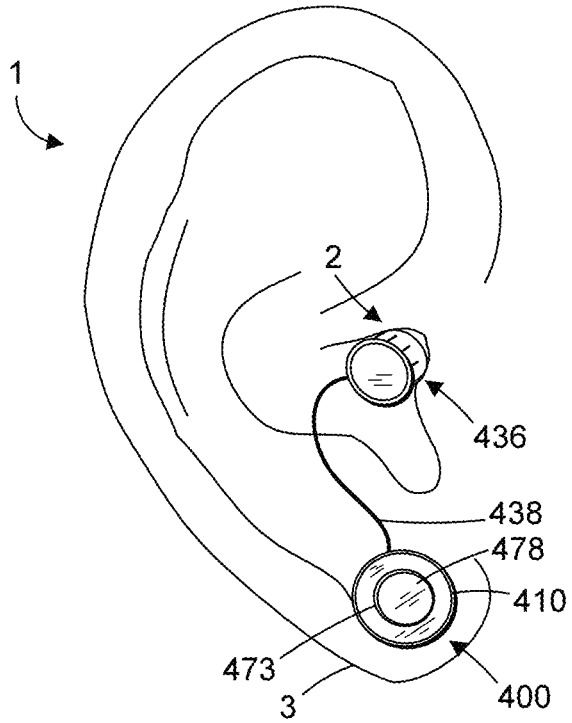
FIG. 19 depicts the audio device of FIG. 16 disposed in a piercing in a lobe of an ear with a sound-production unit extended from the body of the audio device and disposed in the ear canal of the user in accordance with an embodiment of the invention.
Figure 20:
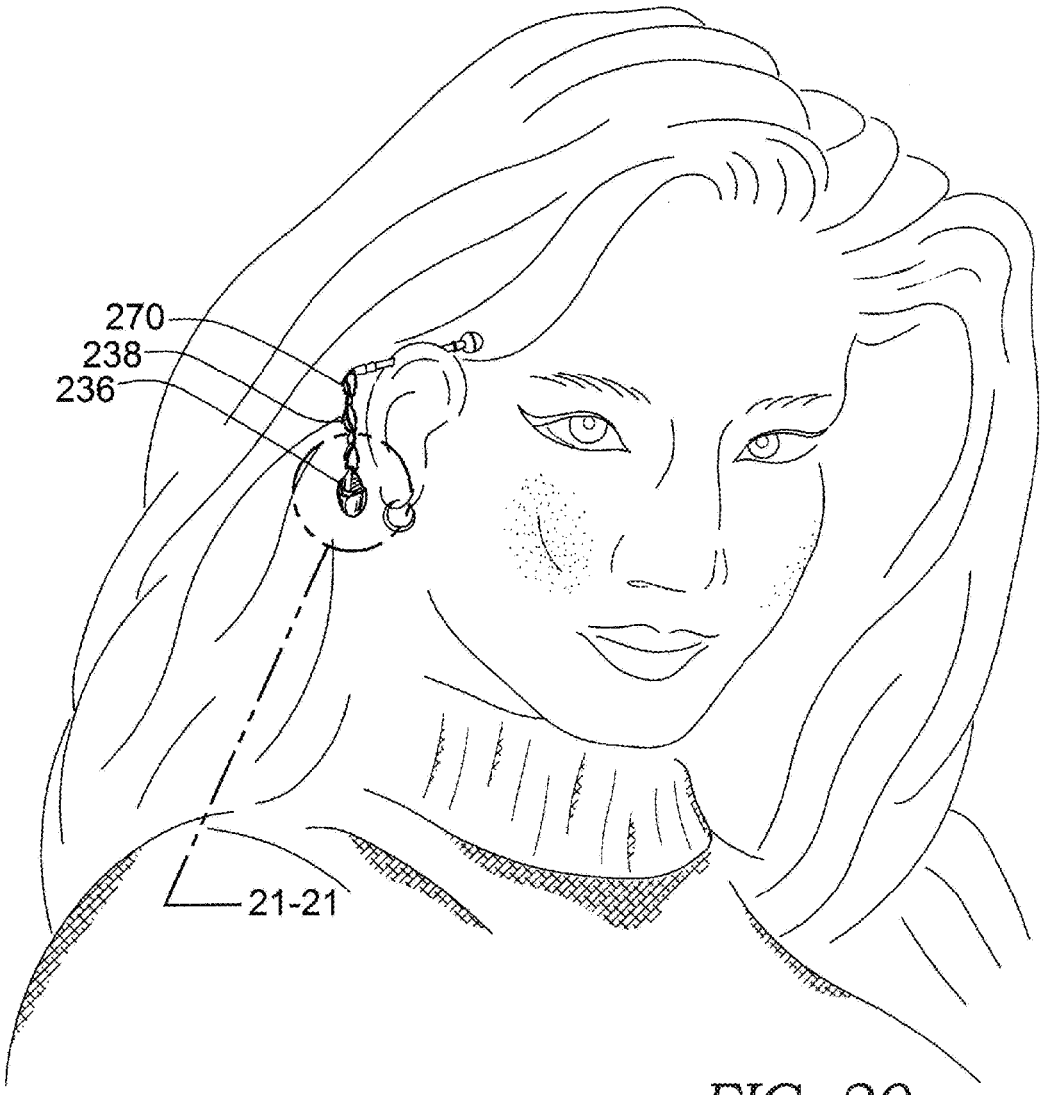
FIG. 20 is an illustrative view of a user wearing an audio device disposed in a piercing in the pinna of an ear depicted in accordance with an embodiment of the invention.
Figure 21:
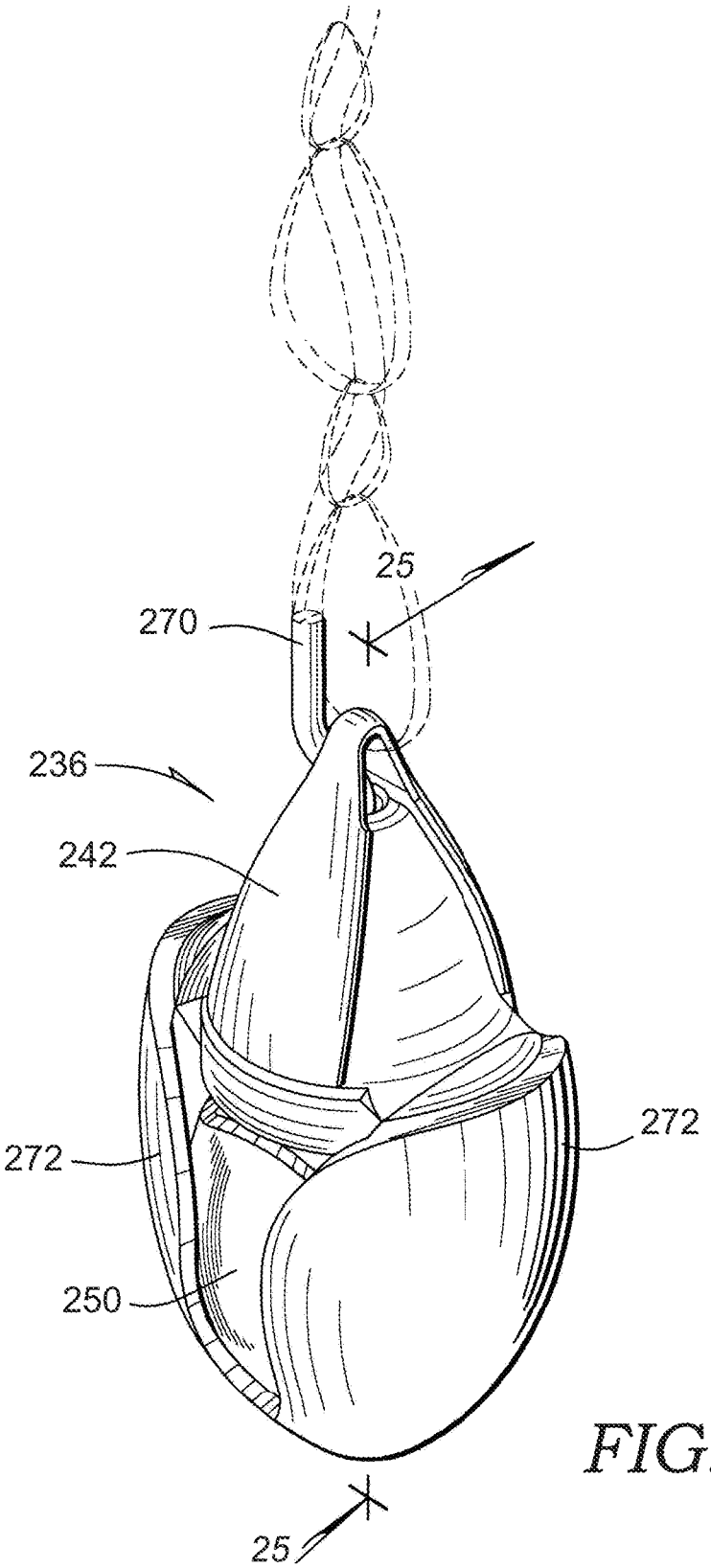
FIG. 21 is a perspective view of a sound-production unit with rotatable leaves that forms a part of the audio device shown in FIG. 20 depicted in accordance with an embodiment of the invention.
Figure 22:
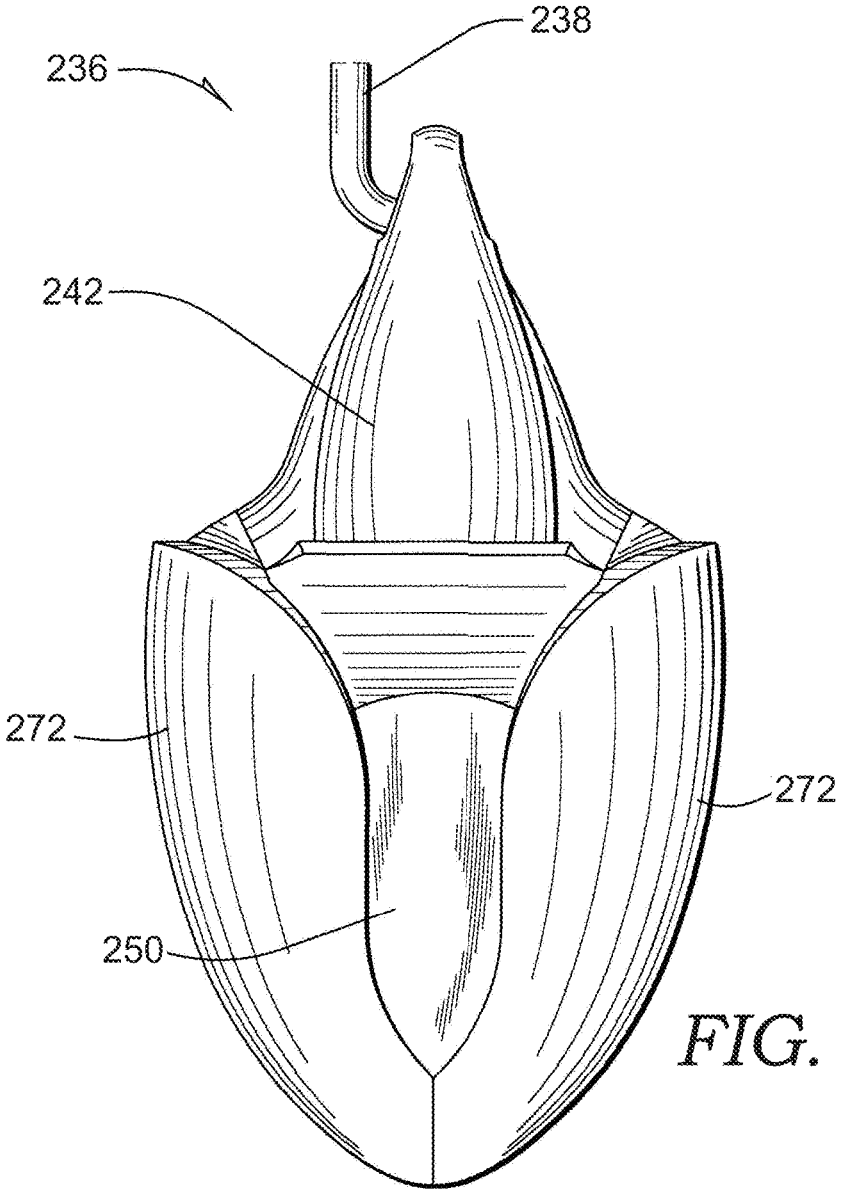
FIG. 22 is a side elevational view of the sound-production unit of FIG. 21.
Figure 23:
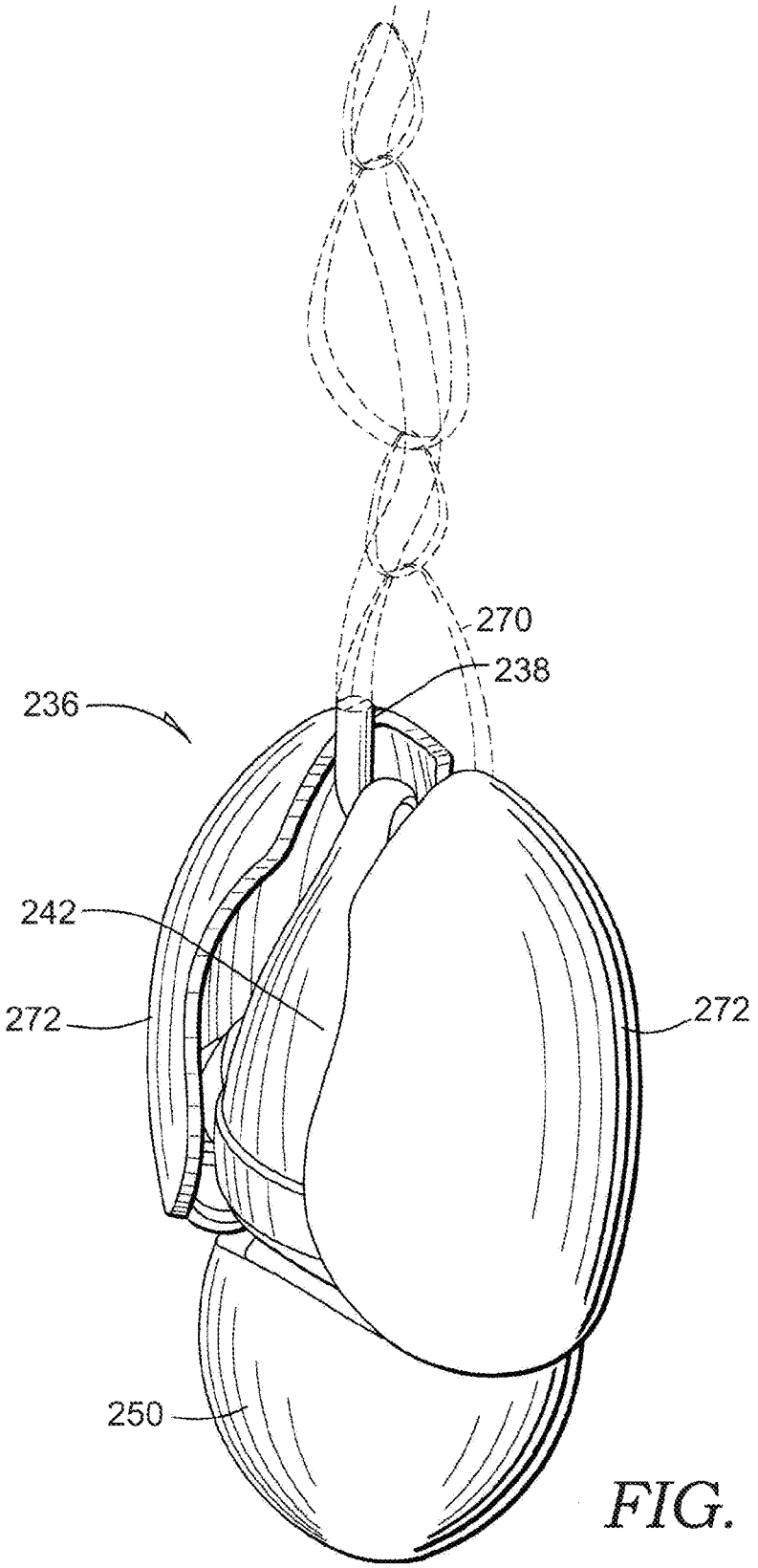
FIG. 23 is a perspective view of the sound-production unit of FIG. 21 shown in a use orientation in accordance with an embodiment of the invention.
Figure 24:
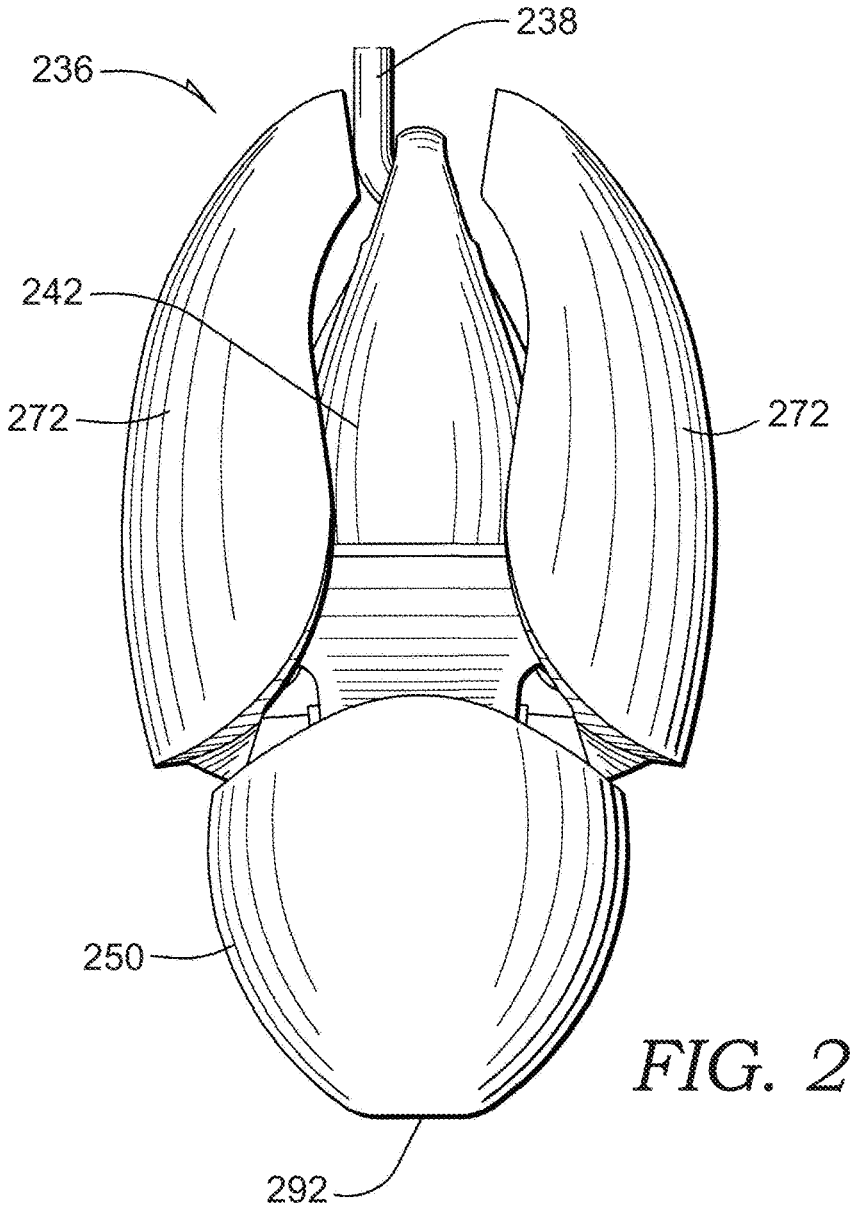
FIG. 24 is a side elevational view of the sound-production unit of FIG. 23.
Figure 25:
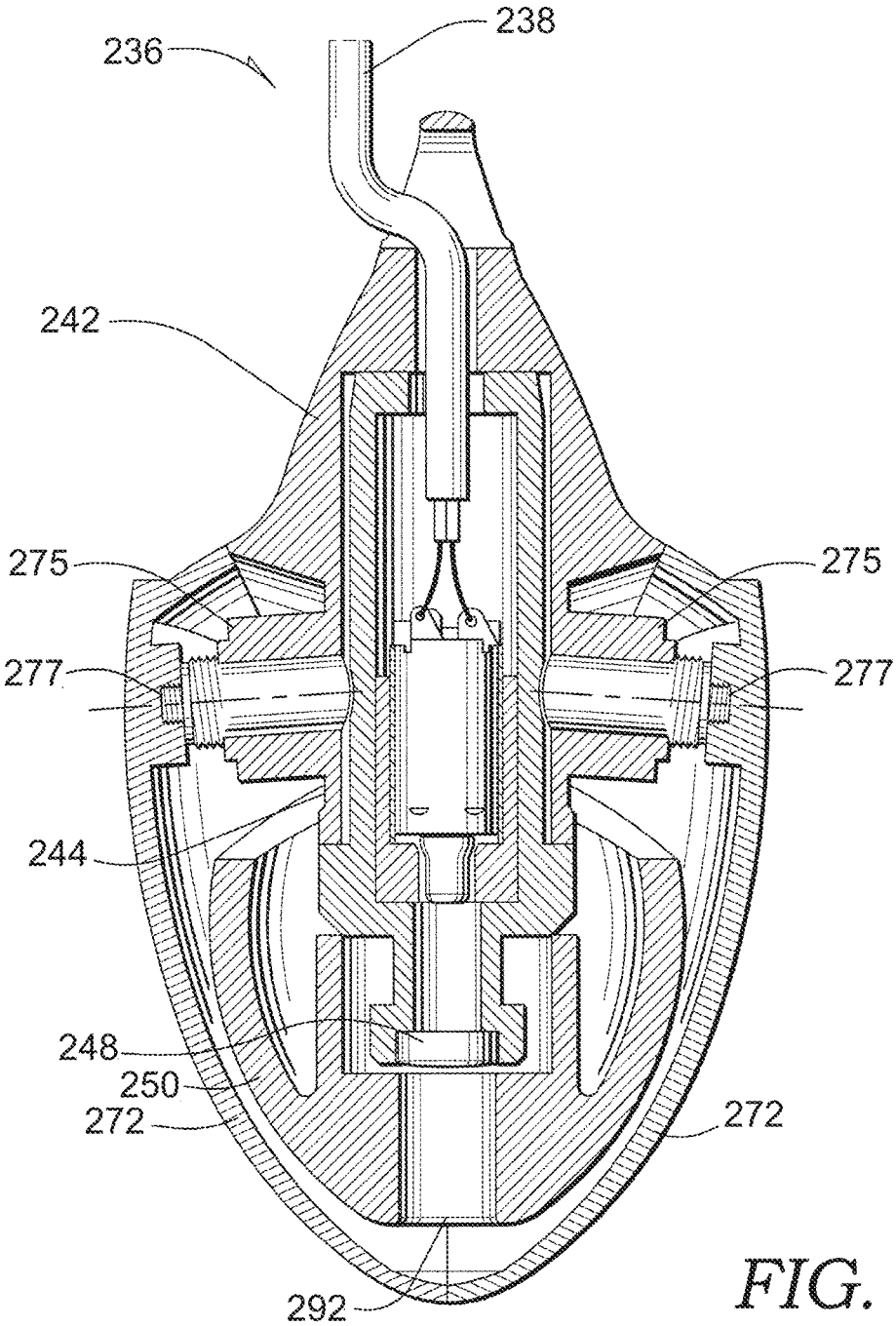
FIG. 25 is a cross-sectional view of the sound-production unit of FIG. 21 in a non-use orientation taken along the line 25-25 depicted in accordance with an embodiment of the invention.
Figure 26:
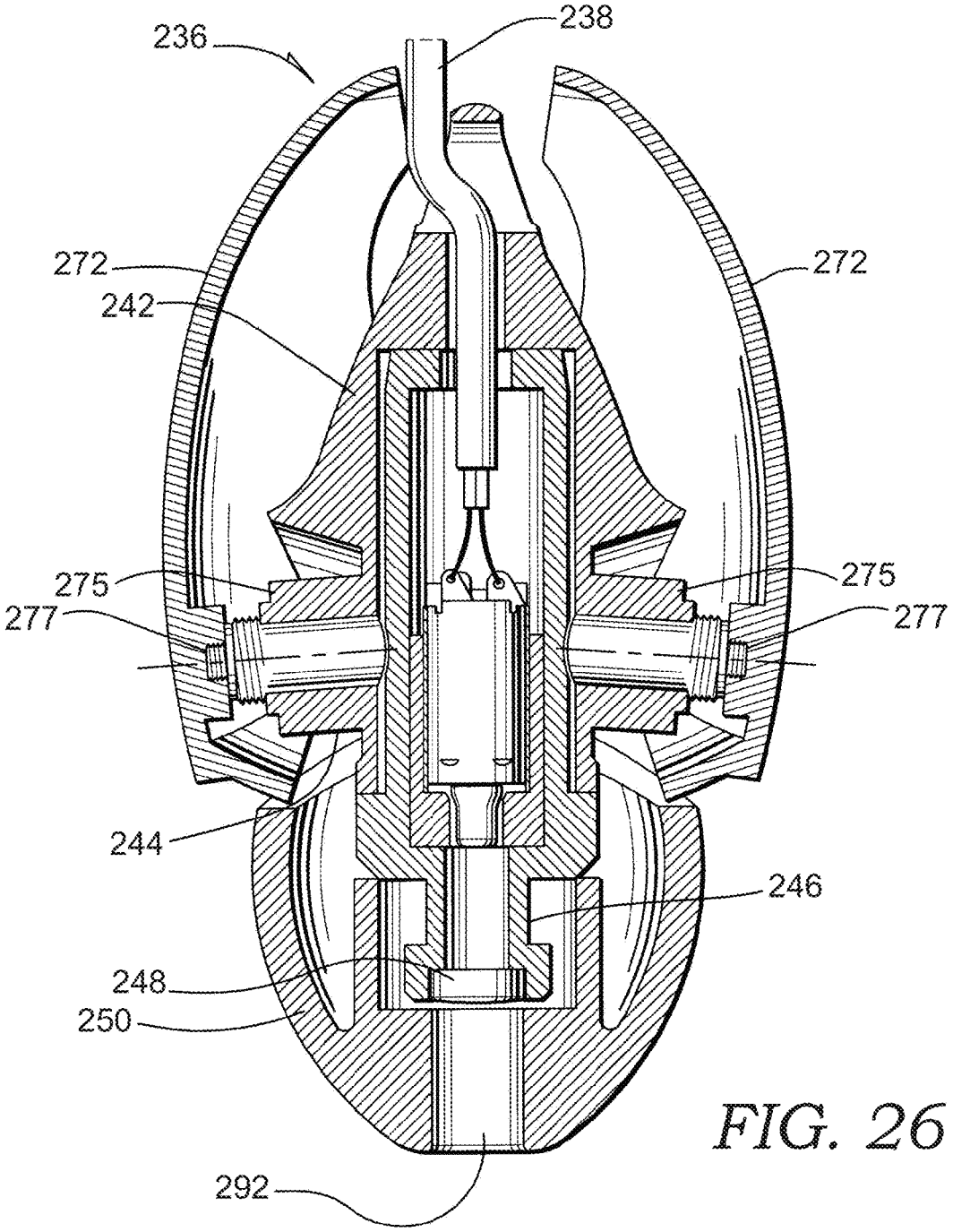
FIG. 26 is a cross-sectional view of the sound-production unit of FIG. 21 taken along the line 25-25 but depicted with the leaves in a use orientation in accordance with an embodiment of the invention.
Figure 28:
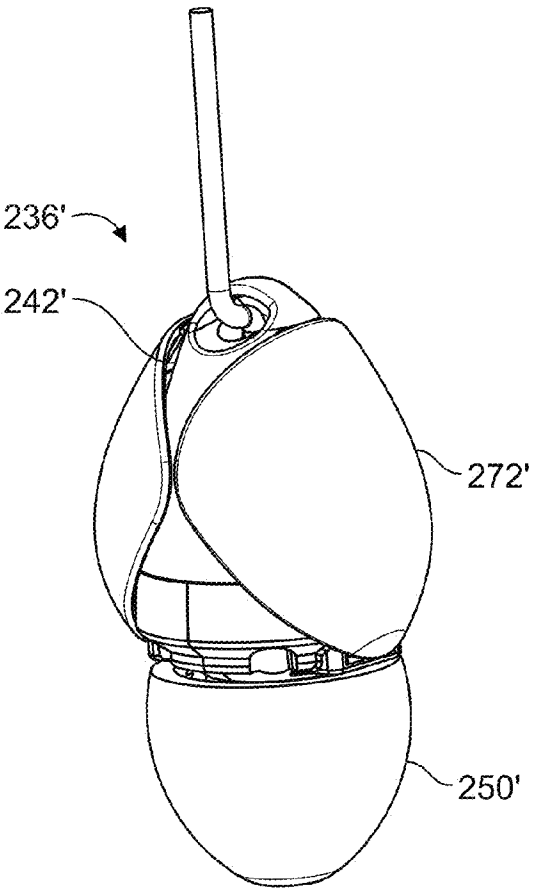
FIG. 28 is a perspective view of the sound-production unit of FIG. 27 shown with the leaves in a use orientation and depicted in accordance with an embodiment of the invention.

With reference to FIGS. 16-19, an audio device 400 is described in accordance with an embodiment of the invention. The audio device 400 is configured as a gauge-style earring and might also be referred to as a tunnel- or plug-style earring. Gauge-style earrings are configured for receipt in an enlarged piercing that is often placed in the lobe 3 as shown in FIGS. 18-19.

The audio device 400 includes a generally ring-shaped body 410 with a hollow interior passage 473 and an annular channel 474 formed about the circumference of the body 410. The annular channel 474 is configured to receive the perimeter of a piercing in the lobe 3 and to thereby retain the audio device 400 within the lobe 3. The lobe 3 is substantially contained between opposite sides or flanges forming the annular channel 474. In some embodiments, the channel 474 comprises only a slight annular recess or is not provided.

The first end 412 of the body includes an annular wall 476 depending therefrom. The control unit 416 is disposed in a cap-shaped housing 418 that includes a generally planar body 478 with a flange 480 extending normally thereto and from the perimeter thereof. The annular wall 476 is received within the flange 480 and the housing 428 to removably couple the control unit 416 to the body 410. It is understood that other available configurations of the housing 418 of the control unit 416 and the coupling with the body 410 will be recognized by one of skill in the art—such configurations are within the scope of embodiments of the invention described herein. For example, the control unit 416 may take a form, such as that of the control units 116 and 216 that couples to a feature disposed on the first end 412 of the body 410.

The housing 442 includes a cylindrical base 444 with a plurality of ribs 447 disposed thereon. An enlarged disc 482 having dimensions larger than the base 444 is provided on the base 444 opposite the ear tip 450. In another embodiment, the enlarged disc 482 is replaced by another ornamental feature, such as a spike, stud, hook, or chain, among a variety of others. Or the enlarged disc 482 may be omitted.

The conductor 438 couples to the base 444 of the housing 442 proximate to the enlarged disc 482. A groove 484, trough, or other depression is provided about the circumference of the body 410 alongside the annular channel 474. The groove 484 is configured to receive the conductor 438 therein. Alternatively, the conductor 438 can be received on the exterior surface of the body 410 without the provision of a groove or other feature to retain the conductor 438. A cutout 486 is provided in a sidewall of the groove 484 to provide for passage of the conductor 438 from the housing 442 through the sidewall and into the groove 484. As best depicted in FIG. 14, the conductor 438 can thus be disposed through the cutout 486 and into the groove 484 to wrap around the circumference of the body 410 before communicatively coupling with the control unit 416. The end of the conductor 438 opposite the sound-production unit 436 may insert into the body 410 and extend therein to a coupling with the control unit 416. The conductor 438 might alternatively insert into the body 410 to couple to a printed circuit or other electrical contact. Or the conductor 438 may be routed into the interior passage 473 and then toward the control unit 416 for coupling therewith.

The sound-production unit 436 and the conductor 438 are disposable in a stowed position (FIGS. 16-18) and a use position (FIG. 19). In the stowed position, the sound-production unit 436 is at least partially inserted into the interior passage 473 of the body 410 to place the nipple 446 of ear tip 450 adjacent or in contact with an interior surface of the control unit 416. The ribs 447 may frictionally engage the wall of the interior passage 473 to retain the sound-production unit 436 in the stowed position. In the stowed position, the conductor 438 is disposed and retained in the groove 484.

To move the sound-production unit 436 to the use position as shown in FIG. 19, the enlarged disc 482 is grasped by the user and pulled to remove the sound-production unit 436 from the interior passage 473 of the body 410. A small gap may be provided between the second end 414 of the body 410 and the enlarged disc 482 to aid grasping thereof. The conductor 438 is removed from the groove 484 and the sound-production unit 436 extended and inserted into the space proximate the ear canal 2 a directed toward or into the ear canal 2.

Operation of the audio device 400 corresponds with the operation of the audio device 100 described above and is thus not described in detail here. As described previously, the signal path of signals embodying the audio file received from the master device travels from a first side of the pinna 1, through the body 410 of the audio device 400 and thus through the pinna 1, and through the conductor 438 to the space proximate ear canal 2 where the audio output is finally provided and directed toward or into the ear canal 2.

When not in use for production of audio output, the audio device 400 is wearable as a decorative earring. The enlarged disc 482, as well as the body 410 and the housing 418 of the control unit 416 can be adorned with any desired ornamentation. The enlarged disc 482 may also obscure or hide the conductor 438 extending from the housing 442 to the groove 484.

Additionally, the control unit 416 and/or the sound-production unit 436 may be detachable from the body 410 for use with a different body 410. For example, in the practice of wearing gauge-style piercings, users often slowly increase the size or gauge of the earring and thus the size of the piercing in the ear. As such, when the user wishes to increase (or decrease) the size of the body 410, a new larger body 410 is obtained and the control unit 416 and/or sound-production unit 436 are coupled to the new larger body 410. The user is thus not required to obtain an entirely new audio device 400. In an embodiment, the audio device is provided with a set of interchangeable bodies 410 of varied sizes.

In another embodiment, the audio device 400 is configured to include a connector coupled to a sound-production unit, like the connector 266 and the sound-production unit 236 discussed previously with respect to the audio device 200. Such a connector and sound-production unit may be provided instead of or in addition to the sound-production unit 436. As such, the audio device 400 could be configured with a suspended or dangling sound-production unit like that shown in FIG. 9, for example.

In use, a pair of the audio devices 100, 200, 300, 400 may be employed—one in each ear—to listen to an audio output in both ears at the same time. The pair of audio devices can comprise two like audio devices 100, 200, 300, 400 or different devices can be selected, e.g. an audio device 100 can be used in one ear while an audio device 300 is used in the other ear.

Several particular embodiments of the audio devices 100, 200, 300, 400 are described herein. However, the scope of embodiments is not limited to the described forms of the audio devices 100, 200, 300, 400. Embodiments of the audio devices 100, 200, 300, 400 may employ other forms for the body 110, 210, 310, 410 and may incorporate or combine various features of each of the audio devices 100, 200, 300, 400 to provide a different configuration but with the same or combined functionalities.

For example, FIGS. 47-50 depict additional exemplary embodiments in which the body 510 comprises a hook-shaped member that is installed through a piercing in a user's ear. The control unit 516 is coupled to one end of the body 510 on one side of the user's ear and the sound production unit 536 is coupled to the opposite end of the body 510 along with an ornamental structure 537. The sound production unit 536 and the conductor 538 may be disposed in, wrapped around, coupled to, or otherwise associated with the ornamental structure 537 to provide an aesthetic design, to disguise the conductor 538 and the sound production unit 536 as part of the aesthetic design, and/or to retain the sound production unit 536 and the conductor 538 in a non-use orientation.

As depicted in FIG. 47, the sound production unit 536 is disposed in a loop-portion of the ornamental structure 537 and a cover 552 is coupled thereto to enclose the ear tip 550. FIG. 48 depicts a spiraling ornamental structure 537' about which the conductor 538' is wrapped and from which the sound production unit 536' hangs. Similarly, FIG. 49 depicts a snaking ornamental structure 537" having pins or a pinch channel disposed on one surface thereof. The conductor 538" is either wrapped around the pins or disposed within the pinch channel to follow the snaking structure 537" and the sound production unit 536" hangs from the conductor 538" at the terminal end of the structure 537". A cover 552" may be coupled to the sound production unit 536".

The audio device 500''' depicted in FIG. 50 includes an ornamental structure 537''' that forms a cage or skeleton within which the conductor 538''' and the sound production unit 536''' are disposed. The cage structure 537''' includes an opening along one side thereof through which the conductor 538''' and the sound production unit 536''' can be moved to transition between use and non-use orientations. A terminal ring of the cage structure 537''' includes a C-shape with the opening of sufficient dimensions to allow the sound production unit 536''' to pass through when the ear tip 550''' is compressed, deformed, or otherwise flexed to decrease the overall diameter thereof. The ear tip 550''' resumes its normal expanded state after passing through the opening and is substantially enclosed by the C-shaped ring of the structure 537''' when disposed therein.

With reference now to FIGS. 51A-55B, in another embodiment, an audio device 600 is configured as an integrated unit that can be disposed substantially entirely within the pinna 1 of a user's ear. The components of the audio device 600, such as the control unit 616 and the sound-production unit 636 are integrated into the body 610 such that the audio device 600 can be disposed and retained at least partially in the ear canal 2 of a user's ear in a use orientation. In a non-use orientation, the audio device 600 is removed from the user's ear and can be placed in a cover 652.

The components can be arranged and integrated to provide substantial size benefits. For example, in one embodiment, the audio device 600 is about 1.0 centimeter in overall length and weighs less than about 30 grams or preferably less than about 20 grams or more preferably less than about 10 grams. Such size enables the audio device 600 to be comfortably placed into the ear of the user without being highly visible to bystanders.

The body 610 of the audio device 600 is generally cylindrical and includes a gripping feature 681 on the outer circumferential wall thereof near the first end 612. The gripping feature 681 comprises a recess or protuberance such as an annular groove that is engageable by, for example, a user's fingernail to withdraw the audio device 600 from the user's ear canal 2. The control unit 616 is disposed within the first end 612 of the body 610. A control surface 634, such as a capacitive surface, may be provided on the first end 612 of the body 610 to allow the user to provide touch-based commands to the control unit 616. In one embodiment, a radar-based, non-touch control system is included in the control unit 616 to allow the user to provide commands via hand movements or gestures. Exemplary radar-based control systems include those developed by the Advanced Technology and Projects team at Google, Inc. referred to as Project Soli and described in U.S. patent application Ser. Nos. 14/504,038 and 14/513,875.

The sound production unit 636 is disposed at the second end 614 of the body 610. The sound production unit 636 may be partially disposed within the second end 614 of the body 610 or may couple to the second end 614. In one embodiment, the sound production unit 636 is directly electrically coupled to and/or mounted on a circuit board forming an end of the control unit 616 which may aid in reducing the size of the audio device 600. As depicted in FIG. 51B, only a small space for solder or braze material between electrical contacts of the sound production unit 636 and the control unit 616 is provided. As discussed previously with respect to FIG. 5, the control unit 616 houses a variety of components configured for operation of the audio device 600 including one or more of a battery, on-board memory, a processor or logic chip, a wireless communications unit, a microphone, and an amplifier, among others.

Due to the placement of the audio device 600 within the ear canal 2, the audio device 600 may include a bone-conduction microphone and may incorporate one or more sensors configured to detect biological data and/or movement data associated with the user. For example, the sensors may detect a user's body temperature, perspiration, blood pressure, and pulse among other biological data. Sensors such as accelerometers may be provided to detect a number of steps taken by the user and the intensity of the user's movements among other data useable to determine the user's level of activity, caloric expenditures, or the like.

The control unit 616 may be provided with software configured to collect biological data and/or movement data, process the data, and perform calculations based on the data the results of which can be provided to the user audibly or communicated to an associated mobile device, such as a smartphone or the like. Alternatively, tasks associated with collecting and/or processing the data can be offloaded to the mobile device.

In one embodiment, the sound-production unit 636 comprises a speaker with a diaphragm or cone surrounded by a rigid frame 683. The frame 683 may be formed by the body 610 or may be coupled to the body 610. The frame 683 provides an annular ring that surrounds the speaker cone and provides a mounting location for the ear tip 650.

The ear tip 650 comprises a section of material similar to those described previously with respect to the ear tip 150, e.g. silicon, and extends around the annular ring of the frame 683 to form a generally torus-shaped member surrounding the annular ring. Although the ear tip 650 is described as having a torus shape, it is understood that other forms may be employed without departing from the scope of embodiments of the invention described herein, e.g. forms in which a non-circular polygonal or curvilinear shape is revolved about an axis. Forms of the ear tip 650 may also comprise non-uniform forms that vary in shape and/or size around the frame 683. Such non-uniform ear tips 650 might provide a tailored fit for individual users and/or users with non-uniformly shaped ear canals 2.

The outer diametrical dimension of the ear tip 650 is generally equal to or larger than that of the body 610 and is sized to fit within the ear canal 2 of the user while also forming a seal between the ear tip 650 and the wall of the ear canal 2. The ear tip 650 may at least partially deform to conform to the shape of the user's ear canal 2. The fit with the ear canal 2 is sufficient to provide friction to retain the audio device 600 within the ear canal 2 but not cause discomfort or irritation thereof. In one embodiment, the ear tip 650 is removable and/or replaceable on the annular ring to allow ear tips 650 of different sizes/dimensions to be interchanged, thereby allowing a user to obtain a desired fit. In another embodiment, the ear tip 650 is molded onto the frame 683; sizing of the ear tip 650 with respect to the user's ear canal 2 is thus achieved by selecting an audio device 600 having an ear tip 650 molded thereon with appropriate dimensions.

The ear tip 650 and the seal provided between the ear tip 650 and the interior of the ear canal 2 may provide at least partial noise isolation, e.g. prevent a majority of environmental sounds from traveling through the ear canal 2 and being heard by the user. In one embodiment, the ear tip 650 prevents substantially all environmental noise from being heard by the user the ear canal 2; it is understood that some environmental noise may be heard by the user through the body, e.g. skin and bones, and not via travel through the ear canal 2.

The audio device 600 may also be configured to provide active noise cancellation and/or pass-through of at least a portion of environmental noise by means known in the art. As described herein, noise cancellation includes production of sound waves of opposite phase to those received from the environment (also referred to as destructive interference) in order to cancel out the environmental sound waves and effectively reduce the volume of the environmental sound waves that is perceivable by the user. Pass-through or audio transparency is understood as reproduction of sounds received from the environment by the audio device 600 such that the user can hear the reproduced sounds. The environmental sounds may be filtered or otherwise processed before being reproduced via the sound-production unit 636. The level of noise cancellation and/or pass-through may be selectively adjustable by the user.

As depicted in FIGS. 52A-B, the cover 652 forms a cavity of sufficient dimensions to receive the audio device 600 therein. The cavity may be dimensioned to form a close fitting relationship with the audio device 600 to provide a friction-fit or mechanical engagement with the audio device 600 to removably retain the audio device 600 therein. The cover 652 might include a lid or cap to retain the audio device 600 within the cavity.

The cover 652 can be configured to provide charging of a battery in the audio device 600 when installed therein. Charging of the battery is preferably conducted via an inductive charging means, but may alternatively be performed via engagement of electrical contacts provided on the exterior of the body 610 and the interior surface of the cover 652. The cover 652 may include a battery or be coupled to a mobile device or power grid that provides a source of electrical power for the charging operation.

The cover 652 can be a standalone component that can be coupled to a personal article that is wearable by a user, or the cover 652 can be integrated into a wearable personal article. Wearable personal articles include, for example, but not limitation, jewelry, eyeglasses, watches, belt buckles, belts, bracelets, hats, headbands, shirts, pants, shoes, or other personal items that can be worn by a user on his or her body.

For example, in one embodiment depicted in FIGS. 52A-B, the cover 652 comprises a gauge-style piercing like that described previously with respect to the audio device 400. The cover 652 comprises a ring with a bore extending axially therethrough in which the audio device 600 can be disposed in friction-fitting manner. The cover 652 may be worn or installed in a piercing in the lobe 3 of a user's ear.

In another embodiment depicted in FIGS. 53A-B, a cover 652' comprises a cylindrical form with a blind bore extending into one end thereof. The cover 652' is formed integrally with temple pieces 671 of a pair of eyeglasses 679. The cover 652' might alternatively be formed to include a clip or a pair of arms extending from the outer surface thereof that are configured to grasp the temple 671 of the pair of eyeglasses 679 or any of a variety of other wearable personal articles. The audio device 600 can be disposed in the cover 652' for storage in a non-use orientation or removed therefrom and installed in the ear canal 2 of the user in a use orientation.

Referring now to FIGS. 54A-B, in another embodiment, a cover 652" is integrated into the end of the temple or at the temple tip, e.g. the blind bore is formed to extend into the temple tip. In other exemplary embodiments, a cover 652'" is integrated into a watchband 667 as depicted in FIGS. 55A-B or might be integrated into a headband, a hat, or another personal article.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

What is claimed is:

1. A wearable audio device comprising:

a sound-production-unit (SPU) housing with a sound-production unit disposed at least partially therein;

an ear tip coupled to the SPU housing and adapting the SPU housing for insertion and retention at least partially within a pinna of a user's ear; and a cover associated with the SPU housing, the SPU housing and the cover being moveable relative to one another between a non-use orientation in which the cover substantially encloses the ear tip and the cover and SPU housing are suspended from the pinna of the user's ear and a use orientation in which the ear tip is unobstructed by the cover and is disposable into the pinna of a user's ear to direct sound produced by the sound-production unit into an ear canal of the user's ear.

2. The wearable audio device of claim 1, wherein in the non-use orientation the is cover and SPU housing are suspended from a piercing in the pinna of the user's ear and the cover encloses and disguises the ear tip to resemble a piece of jewelry.

3. The wearable audio device of claim 1, further comprising:

a piercing-body having a first end and an opposite second end, the piercing-body extending through a piercing in the ear of the user with the ear being positioned between the first and second ends along the length of the piercing-body; and a communication-component housing that includes a wireless-communication component disposed therein, the communication-component housing being coupled to the first end of the piercing-body and communicatively coupling the audio device to a master device, wherein the SPU housing is tethered to the second end of the piercing-body and is communicatively coupled to the wireless-communication component via the body.

4. The wearable audio device of claim 3, further comprising a first connector and a second connector, the first connector being coupled between the first end of the piercing body and the communication-component housing and the second connector is coupled between the second end of the body and a conductor extending from the SPU housing.

5. The wearable audio device of claim 1, wherein the cover is suspended in a position substantially beneath the ear of the user in the use orientation and the non-use orientation.

6. The wearable audio device of claim 1, wherein the cover includes a feature for retaining a conductor that is coupled to the SPU housing.

7. The wearable audio device of claim 6, wherein the conductor is wrapped around the feature.

8. The wearable audio device of claim 6, wherein the feature comprises a channel into which the conductor is removeably disposed and retained.

9. A wearable audio device comprising:

a sound-production-unit (SPU) housing with a sound-production unit disposed at least partially therein, the SPU housing including an exterior face;

an ear tip coupled to the SPU housing and adapting the SPU housing for insertion and retention at least partially within a pinna of a user's ear in a use orientation;

a cover including a body with a hollow interior space, the body forming an incomplete three-dimensional form, the hollow interior space being dimensioned to receive the ear tip and at least a portion of the SPU housing therein, in a non-use orientation the exterior face of the SPU housing completes the three-dimensional form of the body and the ear tip and SPU housing are installed at least partially in the interior space, the cover being suspended from the pinna of the user's ear and supporting the SPU housing in the non-use orientation, the SPU housing being removable from the body to place the SPU housing and ear tip in the use orientation.

10. The wearable audio device of claim 9, wherein the cover includes a channel extending along a surface thereof and intersecting an opening to the hollow interior space, and wherein the SPU housing includes a conductor extending therefrom, in the non-use orientation the conductor being disposed at least partially within the channel.

11. The wearable audio device of claim 9, further comprising:

a piercing-body having a first end and an opposite second end, the piercing-body extending through a piercing in the pinna of the user's ear with the ear being positioned between the first and second ends along the length of the piercing-body; and a communication-component housing that includes a wireless-communication component disposed therein, the communication-component housing being coupled to the first end of the piercing-body and communicatively coupling the audio device to a master device, wherein the SPU housing is tethered to the second end of the piercing-body and is communicatively coupled to the wireless-communication component via the body.

12. The wearable audio device of claim 11, further comprising a first connector and a second connector, the first connector being coupled between the first end of the piercing body and the communication-component housing and the second connector being coupled between the second end of the body and a conductor extending from the SPU housing.

13. The wearable audio device of claim 9, further comprising:

a conductor extending from the SPU housing, and wherein the cover includes a feature around which the conductor is wrapped to retain the conductor in the non-use orientation.

14. A wearable audio device comprising:

a sound-production-unit (SPU) housing with a sound-production unit disposed at least partially therein, the SPU housing including a distal end from which sound produced by the sound-production unit is directed, the SPU housing being moveable between a use orientation and a non-use orientation, the distal end being configured for insertion at least partially into a pinna of a user's ear to direct the sound toward an ear canal of the user in the use orientation; and a cover that is suspended from the pinna and forming an incomplete three-dimensional form with a hollow interior space configured to removeably receive at least the distal end of the SPU housing therein in the non-use orientation.

15. The wearable audio device of claim 14, wherein the SPU housing includes an exterior face and in the non-use orientation the exterior face of the SPU housing completes the three-dimensional form of the cover and encloses the remainder of the SPU housing within the hollow interior space of the cover.

16. The wearable audio device of claim 14, further comprising:

an eartip coupled to the distal end of the SPU housing, the eartip adapting the housing for insertion and retention at least partially within the pinna of the user's ear.

17. The wearable audio device of claim 14, further comprising:

a piercing-body having a first end and an opposite second end, the piercing-body extending through a piercing in the pinna of the user's ear with the ear being positioned between the first and second ends along the length of the piercing-body; and a communication-component housing that includes a wireless-communication component disposed therein, the communication-component housing being coupled to the first end of the piercing-body and communicatively coupling the audio device to a master device, wherein the SPU housing is tethered to the second end of the piercing-body and is communicatively coupled to the wireless-communication component via the body.

18. The wearable audio device of claim 17, further comprising a first connector and a second connector, the first connector being coupled between the first end of the piercing body and the communication-component housing and the second connector being coupled between the second end of the body and a conductor extending from the SPU housing.

19. The wearable audio device of claim 14, further comprising:

a conductor extending from the SPU housing, and wherein the cover includes a feature around which the conductor is wrapped to retain the conductor in the non-use orientation.

* * * * *